US009196198B2

(12) United States Patent
Buckley et al.

(10) Patent No.: US 9,196,198 B2
(45) Date of Patent: Nov. 24, 2015

(54) HUE SEQUENTIAL DISPLAY APPARATUS AND METHOD

(71) Applicant: Pixtronix, Inc., San Diego, CA (US)

(72) Inventors: Edward Buckley, Melrose, MA (US); Fahri Yaras, Chelsea, MA (US)

(73) Assignee: Pixtronix, Inc., San Diego, CA (US)

( * ) Notice: Subject to any disclaimer, the term of this patent is extended or adjusted under 35 U.S.C. 154(b) by 79 days.

(21) Appl. No.: 14/095,580

(22) Filed: Dec. 3, 2013

(65) Prior Publication Data

US 2015/0154920 A1 Jun. 4, 2015

(51) Int. Cl.

| | |
|---|---|
| ***G09G 5/10*** | (2006.01) |
| ***G09G 3/34*** | (2006.01) |
| ***G09G 3/20*** | (2006.01) |

(52) U.S. Cl.

CPC ..... *G09G 3/3413* (2013.01); *G09G 3/2022* (2013.01); *G09G 2310/0235* (2013.01); *G09G 2340/06* (2013.01); *G09G 2360/16* (2013.01)

(58) Field of Classification Search

CPC . G09G 3/2003; G09G 3/2022; G09G 3/3413; G09G 3/3607; G02F 1/133; H04N 1/6075; H04N 9/3197

See application file for complete search history.

(56) References Cited

U.S. PATENT DOCUMENTS

| | | | | |
|---|---|---|---|---|
| 5,452,017 | A * | 9/1995 | Hickman | 348/646 |
| 5,631,749 | A * | 5/1997 | Ueda | 358/520 |
| 6,034,665 | A * | 3/2000 | Kim | 345/593 |
| 6,337,692 | B1 * | 1/2002 | Rai et al. | 345/594 |
| 6,788,441 | B1 * | 9/2004 | Ohkawa | 358/520 |
| 6,814,420 | B2 * | 11/2004 | Fujita et al. | 347/15 |
| 6,980,219 | B2 | 12/2005 | Higgins et al. | |
| 7,872,659 | B2 * | 1/2011 | Seetzen | 345/690 |
| 8,035,655 | B2 | 10/2011 | Kim et al. | |
| 8,687,143 | B2 * | 4/2014 | Feng et al. | 349/61 |
| 8,860,745 | B2 * | 10/2014 | Le | 345/590 |
| 2002/0122019 | A1 | 9/2002 | Baba et al. | |
| 2004/0239762 | A1 * | 12/2004 | Porikli et al. | 348/169 |
| 2007/0036371 | A1 | 2/2007 | Buil et al. | |
| 2007/0064008 | A1 | 3/2007 | Childers | |

(Continued)

FOREIGN PATENT DOCUMENTS

| | | | |
|---|---|---|---|
| EP | 2410509 | A1 | 1/2012 |
| WO | 2005043507 | A1 | 5/2005 |

OTHER PUBLICATIONS

International Search Report and Written Opinion—PCT/US2014/067619—ISA/EPO—Mar. 13, 2015.

*Primary Examiner* — Joe H Cheng

(74) *Attorney, Agent, or Firm* — Edward A. Gordon; Foley & Lardner LLP

(57) ABSTRACT

This disclosure provides systems, methods, non-transitory computer readable storage media, and apparatus for displaying images using hue-based frame-specific contributing colors (FSCCs). In one aspect, an input is configured to receive image data corresponding to a current image frame. Contributing color selection logic is configured, based on received image data, to obtain a set of FSCCs for use in conjunction with a set of frame-independent contributing colors (FICCs) to generate the current or a subsequent image frame on a display. The set of FSCCs are obtained from determining the dominant hues in the image frame. The image frame is displayed such that subframes associated with displaying the FSCCs have weights that are greater than the subframes associated with displaying the FICCs.

23 Claims, 16 Drawing Sheets

(56) References Cited

U.S. PATENT DOCUMENTS

| | | | | |
|---|---|---|---|---|
| 2007/0132675 | A1* | 6/2007 | Asao | 345/80 |
| 2009/0174638 | A1* | 7/2009 | Brown et al. | 345/88 |
| 2011/0007088 | A1 | 1/2011 | Park et al. | |
| 2011/0013041 | A1* | 1/2011 | Abe et al. | 348/222.1 |
| 2011/0084981 | A1* | 4/2011 | Abe et al. | 345/590 |
| 2012/0287168 | A1 | 11/2012 | Botzas et al. | |
| 2014/0049573 | A1* | 2/2014 | Ishihara | 345/691 |
| 2014/0118388 | A1* | 5/2014 | Buckley et al. | 345/593 |
| 2014/0118427 | A1* | 5/2014 | Buckley et al. | 345/691 |

* cited by examiner

HUE SEQUENTIAL DISPLAY APPARATUS AND METHOD

TECHNICAL FIELD

This disclosure relates to the field of displays, and in particular, to the formation of images on field sequential color (FSC)-based displays.

DESCRIPTION OF THE RELATED TECHNOLOGY

Electromechanical systems (EMS) devices include devices having electrical and mechanical elements, such as actuators, optical components (such as mirrors, shutters, and/or optical film layers) and electronics. EMS devices can be manufactured at a variety of scales including, but not limited to, microscales and nanoscales. For example, microelectromechanical systems (MEMS) devices can include structures having sizes ranging from about a micron to hundreds of microns or more. Nanoelectromechanical systems (NEMS) devices can include structures having sizes smaller than a micron including, for example, sizes smaller than several hundred nanometers. Electromechanical elements may be created using deposition, etching, lithography, and/or other micromachining processes that etch away parts of deposited material layers, or that add layers to form electrical and electromechanical devices.

EMS-based display apparatus have been proposed that include display elements that modulate light by selectively moving a light blocking component into and out of an optical path through an aperture defined through a light blocking layer. Doing so selectively passes light from a backlight or reflects light from the ambient or a front light to form an image.

SUMMARY

The systems, methods and devices of the disclosure each have several innovative aspects, no single one of which is solely responsible for the desirable attributes disclosed herein.

One innovative aspect of the subject matter described in this disclosure can be implemented in an apparatus including a plurality of light sources configured to emit a plurality of colors generally corresponding to a set of frame independent contributing colors (FICCs), and a controller coupled to the plurality of light sources. The controller includes input logic configured to receive data indicative of a first image frame, and subfield derivation logic configured to identify at least one frame specific contributing color (FSCC) for use in display of a second image frame, where the second image frame is one of the first image frame and an image frame subsequent to the first image frame, by processing the data at least partially in a hue-based color space to identify a hue angle of a dominant hue in the first image frame, select the FSCC based on the identified hue angle, and cause the second image frame to be displayed using the FICCs and the FSCC.

In some implementations, the subfield logic is further configured to identify three FSCCs by identifying hue angles associated with three dominant hues in the first image frame; and to cause the second image frame to be displayed using the FICCs and the three identified FSCCs. In some other implementations, the subfield derivation logic is further configured to set the FSCC to correspond to the identified dominant hue by obtaining a set of relative illumination intensities for the plurality of light sources based on the identified dominant hue. In some implementations, the subfield derivation logic is further configured to process the data at least partially in the hue-based color space by determining a frequency distribution of a plurality of hues in the first image frame. In some implementations, the subfield derivation logic is further configured to process the data at least partially in the hue-based color space by converting a plurality of pixel values included in the received data from an RGB color space to the hue-based color space.

In some implementations, the controller is configured to display the second image frame using the FICCs and the at least one FSCC such that the majority of the light energy output for the second image frame is output using the at least one FSCC. In some other implementations, the controller is configured to display the second image frame using the FICCs and the at least one FSCC such that at least one subframe caused to be displayed for at least one FICC has a corresponding weight that is less than lowest weight of any subframe displayed for the at least one FSCC.

In some implementations, the subfield derivation logic is further configured to cause the second image frame to be displayed using the FICCs and the FSCC based on a determination that an estimated power consumed by the apparatus for displaying the second image frame using FICCs and the FSCC is less than an estimated power consumed by the apparatus for displaying the second image frame using only FICCs.

In some implementations, the apparatus further includes a display including the plurality of light sources, a processor that is configured to communicate with the display, the processor being configured to process image data, and a memory device that is configured to communicate with the processor. In some implementations, the apparatus further includes a driver circuit configured to send at least one signal to the display, and a controller configured to send at least a portion of the image data to the driver circuit. In some implementations, the apparatus further includes an image source module configured to send the image data to the processor, where the image source module includes at least one of a receiver, transceiver, and a transmitter. In some implementations, the apparatus further includes an input device configured to receive input data and to communicate the input data to the processor.

Another innovative aspect of the subject matter described in this disclosure can be implemented in a method for displaying an image frame including receiving data indicative of a first image frame, processing the received data at least partially in a hue-based color space to identify at least one hue angle associated with at least one dominant hue in the first image frame, selecting at least one frame-specific contributing color (FSCC) based on the at least one hue angle, determining a set of frame-independent contributing colors (FICCs), and displaying a second image frame using the FICCs and the at least one FSCC, where the second image frame is one of the first image frame and an image frame subsequent to the first image frame.

In some implementations, selecting the at least one FSCC includes selecting three FSCCs based on identifying hue angles associated with three dominant hues in the first image frame, and where displaying the second image frame includes displaying the second image frame using the FICCs and the three FSCCs. In some implementations, processing the received data at least partially in the hue-based color space includes determining a frequency distribution of a plurality of hues in the first image frame. In some implementations, processing the received data at least partially in the hue-based color space further includes converting a plurality of pixel values included in the received data from an RGB color space to the hue-based color space.

In some implementations, displaying the second image frame using the FICCs and the at least one FSCC includes displaying the second image frame such that a majority of a light energy output for the second image frame is output using the at least one FSCC. In some implementations, displaying the second image frame using the FICCs and the at least one FSCC includes displaying the second image frame such that at least one subframe caused to be displayed for at least one of the FICCs has a corresponding weight that is less than a lowest weight of any subframe caused to be displayed for the at least one FSCC. In some implementations, displaying the second image frame using the FICCs and the at least one FSCC includes determining that an estimated power consumed for displaying the second image frame using the FICCs and the at least one FSCC is less than an estimated power consumed for displaying the second image frame using only the FICCs.

Another innovative aspect of the subject matter described in this disclosure can be implemented in a non-transitory computer readable storage medium storing computer executable instructions encoded thereon, which when executed by a processor cause the processor to perform a method for displaying an image. The method includes receiving data indicative of a first image frame, processing the received data at least partially in a hue-based color space to identify at least one hue angle associated with at least one dominant hue in the first image frame, selecting at least one frame-specific contributing color (FSCC) based on the at least one hue angle, determining a set of frame-independent contributing colors (FICCs), and displaying a second image frame using the FICCs and the at least one FSCC, where the second image frame is one of the first image frame and an image frame subsequent to the first image frame.

In some implementations, selecting the at least one FSCC includes selecting three FSCCs based on identifying hue angles associated with three dominant hues in the first image frame, and where displaying the second image frame includes displaying the second image frame using the FICCs and the three FSCCs. In some implementations, displaying the second image frame using the FICCs and the at least one FSCC includes displaying the second image frame such that at least one subframe caused to be displayed for at least one of the FICCs has a corresponding weight that is less than a lowest weight of any subframe caused to be displayed for the at least one FSCC. In some implementations, processing the received data at least partially in the hue-based color space includes determining a frequency distribution of a plurality of hues in the first image frame.

Details of one or more implementations of the subject matter described in this specification are set forth in the accompanying drawings and the description below. Although the examples provided in this summary are primarily described in terms of MEMS-based displays, the concepts provided herein may apply to other types of displays, such as liquid crystal displays (LCD), organic light emitting diode (OLED) displays, electrophoretic displays, and field emission displays, as well as to other non-display MEMS devices, such as MEMS microphones, sensors, and optical switches. Other features, aspects, and advantages will become apparent from the description, the drawings, and the claims. Note that the relative dimensions of the following figures may not be drawn to scale.

BRIEF DESCRIPTION OF THE DRAWINGS

Like reference numbers and designations in the various drawings indicate like elements.

DETAILED DESCRIPTION

Figure 1A:
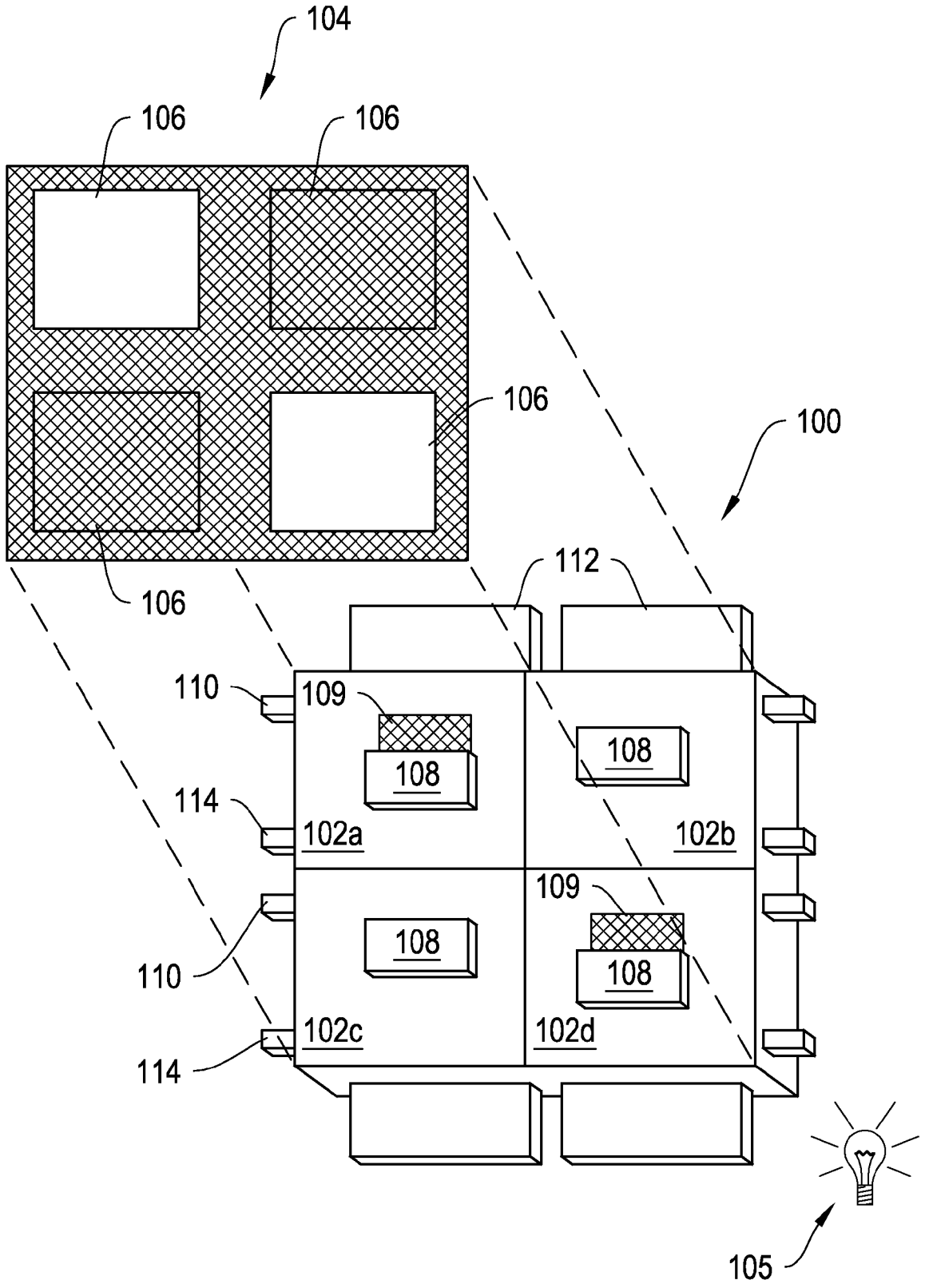
FIG. 1A shows an example schematic diagram of a direct-view microelectromechanical systems (MEMS) based display apparatus.

The following description is directed to certain implementations for the purposes of describing the innovative aspects of this disclosure. However, a person having ordinary skill in the art will readily recognize that the teachings herein can be applied in a multitude of different ways. The described implementations may be implemented in any device, apparatus, or system that can be configured to display an image, whether in motion (such as video) or stationary (such as still images), and whether textual, graphical or pictorial. More particularly, it is contemplated that the described implementations may be included in or associated with a variety of electronic devices such as, but not limited to: mobile telephones, multimedia Internet enabled cellular telephones, mobile television receivers, wireless devices, smartphones, Bluetooth® devices, personal data assistants (PDAs), wireless electronic mail receivers, hand-held or portable computers, netbooks, notebooks, smartbooks, tablets, printers, copiers, scanners, facsimile devices, global positioning system (GPS) receivers/navigators, cameras, digital media players (such as MP3 players), camcorders, game consoles, wrist watches, clocks, calculators, television monitors, flat panel displays, electronic reading devices (such as e-readers), computer monitors, auto displays (including odometer and speedometer displays, etc.), cockpit controls and/or displays, camera view displays (such as the display of a rear view camera in a vehicle), electronic photographs, electronic billboards or signs, projectors, architectural structures, microwaves, refrigerators, stereo systems, cassette recorders or players, DVD players, CD players, VCRs, radios, portable memory chips, washers, dryers, washer/dryers, parking meters, packaging (such as in electromechanical systems (EMS) applications including microelectromechanical systems (MEMS) applications, as well as non-EMS applications), aesthetic structures (such as display of images on a piece of jewelry or clothing) and a variety of EMS devices. The teachings herein also can be used in non-display applications such as, but not limited to, electronic switching devices, radio frequency filters, sensors, accelerometers, gyroscopes, motion-sensing devices, magnetometers, inertial components for consumer electronics, parts of consumer electronics products, varactors, liquid crystal devices, electrophoretic devices, drive schemes, manufacturing processes and electronic test equipment. Thus, the teachings are not intended to be limited to the implementations depicted solely in the Figures, but instead have wide applicability as will be readily apparent to one having ordinary skill in the art.

In one image formation process, a controller selects a set of frame-specific contributing color (FSCC) for use in conjunction with a set of frame-independent contributing colors (FICCs) to form an image frame on a display. In some implementations, the controller selects the FSCCs for a current image frame based on the color content of that image frame. In some other implementations, the controller selects the FSCCs for a subsequent image frame based on the color content of a current image frame.

In some implementations, the controller is configured to determine the FSCCs based on dominant hues within the image frame. In some implementations, the dominant hues can be determined by converting all or a selected set of pixels of the image frame from the RGB color space to the L*a*b* color space. The controller can then determine the N most dominant hue angles or hue angle ranges. The N most dominant hue angles or hue angle ranges can be converted back to the RGB color space to produce a set of N FSCCs.

Particular implementations of the subject matter described in this disclosure can be implemented to realize one or more of the following potential advantages. In general, the image formation processes disclosed herein mitigate color breakup (CBU) in FSC-based displays. The image formation processes do so by generating frame-specific contributing colors (FSCCs) determined in the hue color space instead of the RGB color space. These FSCCs are produced, in a hue-sequential approach, by simultaneously combining light sources of more than one field-independent contributing colors (FICCs), which reduces CBU. In some implementations, the hue-sequential approach can be exploited to reduce the number of subframes needed to reproduce the image frame. Reducing the number of subframes can reduce power consumption of the FSC-based display.

FIG. 1A shows a schematic diagram of an example direct-view MEMS-based display apparatus 100. The display apparatus 100 includes a plurality of light modulators 102*a*-102*d* (generally light modulators 102) arranged in rows and columns. In the display apparatus 100, the light modulators 102*a* and 102*d* are in the open state, allowing light to pass. The light modulators 102*b* and 102*c* are in the closed state, obstructing the passage of light. By selectively setting the states of the light modulators 102*a*-102*d*, the display apparatus 100 can be utilized to form an image 104 for a backlit display, if illuminated by a lamp or lamps 105. In another implementation, the apparatus 100 may form an image by reflection of ambient light originating from the front of the apparatus. In another implementation, the apparatus 100 may form an image by reflection of light from a lamp or lamps positioned in the front of the display, i.e., by use of a front light.

In some implementations, each light modulator 102 corresponds to a pixel 106 in the image 104. In some other implementations, the display apparatus 100 may utilize a plurality of light modulators to form a pixel 106 in the image 104. For example, the display apparatus 100 may include three color-specific light modulators 102. By selectively opening one or more of the color-specific light modulators 102 corresponding to a particular pixel 106, the display apparatus 100 can generate a color pixel 106 in the image 104. In another example, the display apparatus 100 includes two or more light modulators 102 per pixel 106 to provide a luminance level in an image 104. With respect to an image, a pixel corresponds to the smallest picture element defined by the resolution of image. With respect to structural components of the display apparatus 100, the term pixel refers to the combined mechanical and electrical components utilized to modulate the light that forms a single pixel of the image.

The display apparatus 100 is a direct-view display in that it may not include imaging optics typically found in projection applications. In a projection display, the image formed on the surface of the display apparatus is projected onto a screen or onto a wall. The display apparatus is substantially smaller than the projected image. In a direct view display, the user sees the image by looking directly at the display apparatus, which contains the light modulators and optionally a backlight or front light for enhancing brightness and/or contrast seen on the display.

Direct-view displays may operate in either a transmissive or reflective mode. In a transmissive display, the light modulators filter or selectively block light which originates from a lamp or lamps positioned behind the display. The light from the lamps is optionally injected into a lightguide or backlight so that each pixel can be uniformly illuminated. Transmissive direct-view displays are often built onto transparent or glass substrates to facilitate a sandwich assembly arrangement where one substrate, containing the light modulators, is positioned over the backlight.

Each light modulator 102 can include a shutter 108 and an aperture 109. To illuminate a pixel 106 in the image 104, the shutter 108 is positioned such that it allows light to pass through the aperture 109 towards a viewer. To keep a pixel 106 unlit, the shutter 108 is positioned such that it obstructs the passage of light through the aperture 109. The aperture 109 is defined by an opening patterned through a reflective or light-absorbing material in each light modulator 102.

The display apparatus also includes a control matrix connected to the substrate and to the light modulators for controlling the movement of the shutters. The control matrix includes a series of electrical interconnects (such as interconnects 110, 112 and 114), including at least one write-enable interconnect 110 (also referred to as a scan-line interconnect) per row of pixels, one data interconnect 112 for each column of pixels, and one common interconnect 114 providing a common voltage to all pixels, or at least to pixels from both multiple columns and multiples rows in the display apparatus 100. In response to the application of an appropriate voltage (the write-enabling voltage, $V_{WE}$), the write-enable interconnect 110 for a given row of pixels prepares the pixels in the row to accept new shutter movement instructions. The data interconnects 112 communicate the new movement instructions in the form of data voltage pulses. The data voltage pulses applied to the data interconnects 112, in some implementations, directly contribute to an electrostatic movement of the shutters. In some other implementations, the data voltage pulses control switches, such as transistors or other nonlinear circuit elements that control the application of separate actuation voltages, which are typically higher in magnitude than the data voltages, to the light modulators 102. The application of these actuation voltages then results in the electrostatic driven movement of the shutters 108.

Figure 1B:
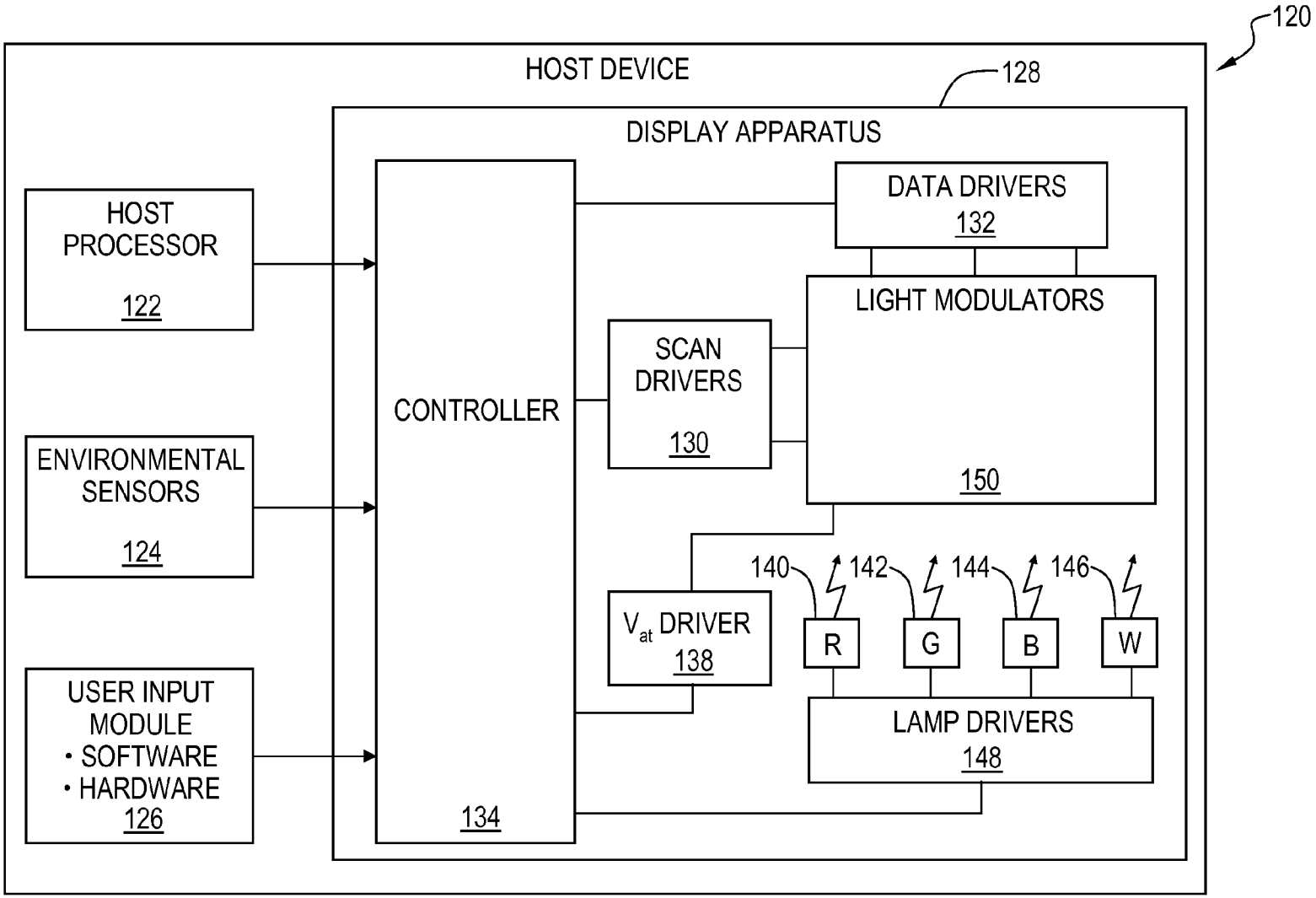
FIG. 1B shows an example block diagram of a host device.

FIG. 1B shows a block diagram of an example host device 120 (i.e., cell phone, smart phone, PDA, MP3 player, tablet, e-reader, netbook, notebook, watch, etc.). The host device 120 includes a display apparatus 128, a host processor 122, environmental sensors 124, a user input module 126, and a power source.

The display apparatus 128 includes a plurality of scan drivers 130 (also referred to as write enabling voltage sources), a plurality of data drivers 132 (also referred to as data voltage sources), a controller 134, common drivers 138, lamps 140-146, lamp drivers 148 and an array 150 of display elements, such as the light modulators 102 shown in FIG. 1A. The scan drivers 130 apply write enabling voltages to scan-line interconnects 110. The data drivers 132 apply data voltages to the data interconnects 112.

In some implementations of the display apparatus, the data drivers 132 are configured to provide analog data voltages to the array 150 of display elements, especially where the luminance level of the image 104 is to be derived in analog fashion. In analog operation, the light modulators 102 are designed such that when a range of intermediate voltages is applied through the data interconnects 112, there results a range of intermediate open states in the shutters 108 and therefore a range of intermediate illumination states or luminance levels in the image 104. In other cases, the data drivers 132 are configured to apply only a reduced set of 2, 3 or 4 digital voltage levels to the data interconnects 112. These voltage levels are designed to set, in digital fashion, an open state, a closed state, or other discrete state to each of the shutters 108.

The scan drivers 130 and the data drivers 132 are connected to a digital controller circuit 134 (also referred to as the controller 134). The controller sends data to the data drivers 132 in a mostly serial fashion, organized in sequences, which may be predetermined, grouped by rows and by image frames. The data drivers 132 can include series to parallel data converters, level shifting, and for some applications digital to analog voltage converters.

The display apparatus optionally includes a set of common drivers 138, also referred to as common voltage sources. In some implementations, the common drivers 138 provide a DC common potential to all display elements within the array 150 of display elements, for instance by supplying voltage to a series of common interconnects 114. In some other implementations, the common drivers 138, following commands from the controller 134, issue voltage pulses or signals to the array 150 of display elements, for instance global actuation pulses which are capable of driving and/or initiating simultaneous actuation of all display elements in multiple rows and columns of the array 150.

All of the drivers (such as scan drivers 130, data drivers 132 and common drivers 138) for different display functions are time-synchronized by the controller 134. Timing commands from the controller coordinate the illumination of red, green, blue and white lamps (140, 142, 144 and 146 respectively) via lamp drivers 148, the write-enabling and sequencing of specific rows within the array 150 of display elements, the output of voltages from the data drivers 132, and the output of voltages that provide for display element actuation. In some implementations, the lamps are light emitting diodes (LEDs).

The controller 134 determines the sequencing or addressing scheme by which each of the shutters 108 can be re-set to the illumination levels appropriate to a new image 104. New images 104 can be set at periodic intervals. For instance, for video displays, the color images 104 or frames of video are refreshed at frequencies ranging from 10 to 300 Hertz (Hz). In some implementations the setting of an image frame to the array 150 is synchronized with the illumination of the lamps 140, 142, 144 and 146 such that alternate image frames are illuminated with an alternating series of colors, such as red, green, blue and white. The image frames for each respective color are referred to as color subframes. In this method, referred to as the field sequential color method, if the color subframes are alternated at frequencies in excess of 20 Hz, the human brain will average the alternating frame images into the perception of an image having a broad and continuous range of colors. In alternate implementations, four or more lamps with primary colors can be employed in display apparatus 100, employing primaries other than red, green, blue and white.

In some implementations, where the display apparatus 100 is designed for the digital switching of shutters 108 between open and closed states, the controller 134 forms an image by the method of time division grayscale, as previously described. In some other implementations, the display apparatus 100 can provide grayscale through the use of multiple shutters 108 per pixel.

In some implementations, the data for an image 104 state is loaded by the controller 134 to the display element array 150 by a sequential addressing of individual rows, also referred to as scan lines. For each row or scan line in the sequence, the scan driver 130 applies a write-enable voltage to the write enable interconnect 110 for that row of the array 150, and subsequently the data driver 132 supplies data voltages, corresponding to desired shutter states, for each column in the selected row. This process repeats until data has been loaded for all rows in the array 150. In some implementations, the sequence of selected rows for data loading is linear, proceeding from top to bottom in the array 150. In some other implementations, the sequence of selected rows is pseudo-randomized, in order to minimize visual artifacts. And in some other implementations, the sequencing is organized by blocks, where, for a block, the data for only a certain fraction of the image 104 state is loaded to the array 150, for instance by addressing only every $5^{th}$ row of the array 150 in sequence.

In some implementations, the process for loading image data to the array 150 is separated in time from the process of actuating the display elements in the array 150. In these implementations, the display element array 150 may include data memory elements for each display element in the array 150 and the control matrix may include a global actuation interconnect for carrying trigger signals, from common driver 138, to initiate simultaneous actuation of shutters 108 according to data stored in the memory elements.

In alternative implementations, the array 150 of display elements and the control matrix that controls the display elements may be arranged in configurations other than rectangular rows and columns. For example, the display elements can be arranged in hexagonal arrays or curvilinear rows and columns. In general, as used herein, the term scan-line shall refer to any plurality of display elements that share a write-enabling interconnect.

The host processor 122 generally controls the operations of the host. For example, the host processor 122 may be a general or special purpose processor for controlling a portable electronic device. With respect to the display apparatus 128, included within the host device 120, the host processor 122 outputs image data as well as additional data about the host. Such information may include data from environmental sensors, such as ambient light or temperature; information about the host, including, for example, an operating mode of the host or the amount of power remaining in the host's power source; information about the content of the image data; information about the type of image data; and/or instructions for display apparatus for use in selecting an imaging mode.

The user input module 126 conveys the personal preferences of the user to the controller 134, either directly, or via the host processor 122. In some implementations, the user input module 126 is controlled by software in which the user programs personal preferences such as deeper color, better contrast, lower power, increased brightness, sports, live action, or animation. In some other implementations, these preferences are input to the host using hardware, such as a switch or dial. The plurality of data inputs to the controller 134 direct the controller to provide data to the various drivers 130, 132, 138 and 148 which correspond to optimal imaging characteristics.

An environmental sensor module 124 also can be included as part of the host device 120. The environmental sensor module 124 receives data about the ambient environment, such as temperature and or ambient lighting conditions. The sensor module 124 can be programmed to distinguish whether the device is operating in an indoor or office environment versus an outdoor environment in bright daylight versus an outdoor environment at nighttime. The sensor module 124 communicates this information to the display controller 134, so that the controller 134 can optimize the viewing conditions in response to the ambient environment.

Figure 2B:
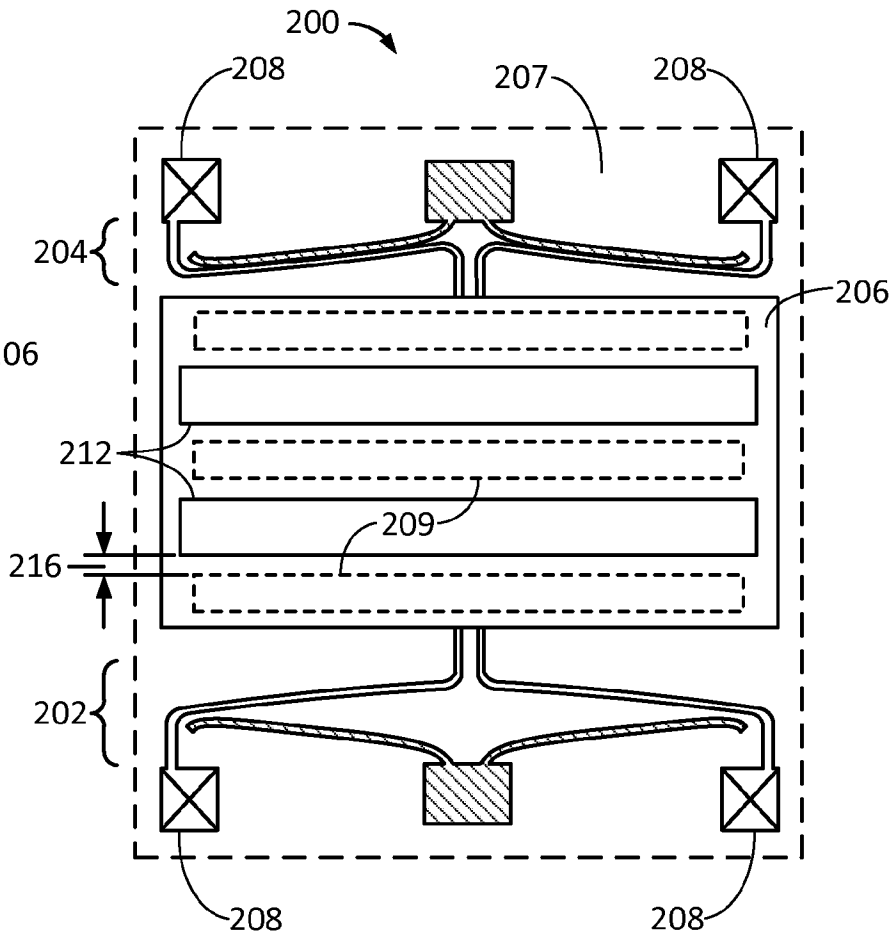
FIGS. 2A and 2B show views of an example dual actuator shutter assembly.
Figure 2A:
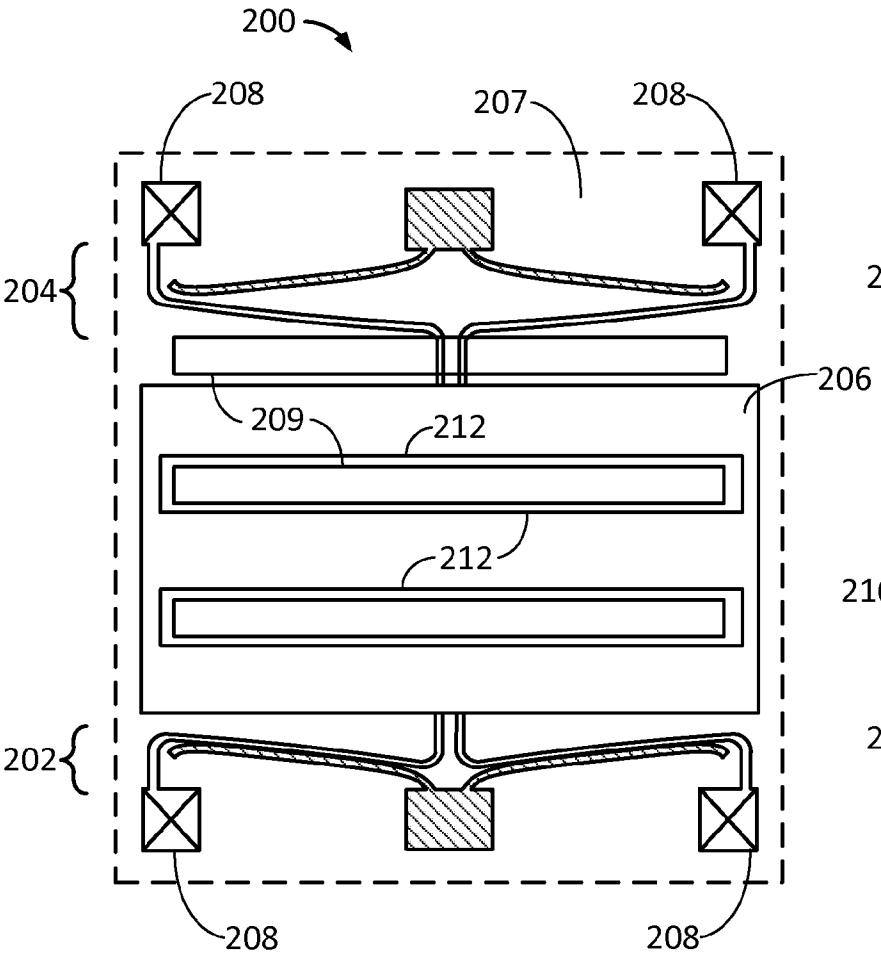

FIGS. 2A and 2B show views of an example dual actuator shutter assembly 200. The dual actuator shutter assembly 200, as depicted in FIG. 2A, is in an open state. FIG. 2B shows the dual actuator shutter assembly 200 in a closed state. The shutter assembly 200 includes actuators 202 and 204 on either side of a shutter 206. Each actuator 202 and 204 is independently controlled. A first actuator, a shutter-open actuator 202, serves to open the shutter 206. A second opposing actuator, the shutter-close actuator 204, serves to close the shutter 206. Both of the actuators 202 and 204 are compliant beam electrode actuators. The actuators 202 and 204 open and close the shutter 206 by driving the shutter 206 substantially in a plane parallel to an aperture layer 207 over which the shutter is suspended. The shutter 206 is suspended a short distance over the aperture layer 207 by anchors 208 attached to the actuators 202 and 204. The inclusion of supports attached to both ends of the shutter 206 along its axis of movement reduces out of plane motion of the shutter 206 and confines the motion substantially to a plane parallel to the substrate.

The shutter 206 includes two shutter apertures 212 through which light can pass. The aperture layer 207 includes a set of three apertures 209. In FIG. 2A, the shutter assembly 200 is in the open state and, as such, the shutter-open actuator 202 has been actuated, the shutter-close actuator 204 is in its relaxed position, and the centerlines of the shutter apertures 212 coincide with the centerlines of two of the aperture layer apertures 209. In FIG. 2B the shutter assembly 200 has been moved to the closed state and, as such, the shutter-open actuator 202 is in its relaxed position, the shutter-close actuator 204 has been actuated, and the light blocking portions of the shutter 206 are now in position to block transmission of light through the apertures 209 (depicted as dotted lines).

Each aperture has at least one edge around its periphery. For example, the rectangular apertures 209 have four edges. In alternative implementations in which circular, elliptical, oval, or other curved apertures are formed in the aperture layer 207, each aperture may have only a single edge. In some other implementations, the apertures need not be separated or disjoint in the mathematical sense, but instead can be connected. That is to say, while portions or shaped sections of the aperture may maintain a correspondence to each shutter, several of these sections may be connected such that a single continuous perimeter of the aperture is shared by multiple shutters.

In order to allow light with a variety of exit angles to pass through apertures 212 and 209 in the open state, it is advantageous to provide a width or size for shutter apertures 212 which is larger than a corresponding width or size of apertures 209 in the aperture layer 207. In order to effectively block light from escaping in the closed state, it is preferable that the light blocking portions of the shutter 206 overlap the apertures 209. FIG. 2B shows an overlap 216, which in some implementations can be predefined, between the edge of light blocking portions in the shutter 206 and one edge of the aperture 209 formed in the aperture layer 207.

The electrostatic actuators 202 and 204 are designed so that their voltage-displacement behavior provides a bi-stable characteristic to the shutter assembly 200. For each of the shutter-open and shutter-close actuators there exists a range of voltages below the actuation voltage, which if applied while that actuator is in the closed state (with the shutter being either open or closed), will hold the actuator closed and the shutter in position, even after an actuation voltage is applied to the opposing actuator. The minimum voltage needed to maintain a shutter's position against such an opposing force is referred to as a maintenance voltage $V_m$.

Figure 3:
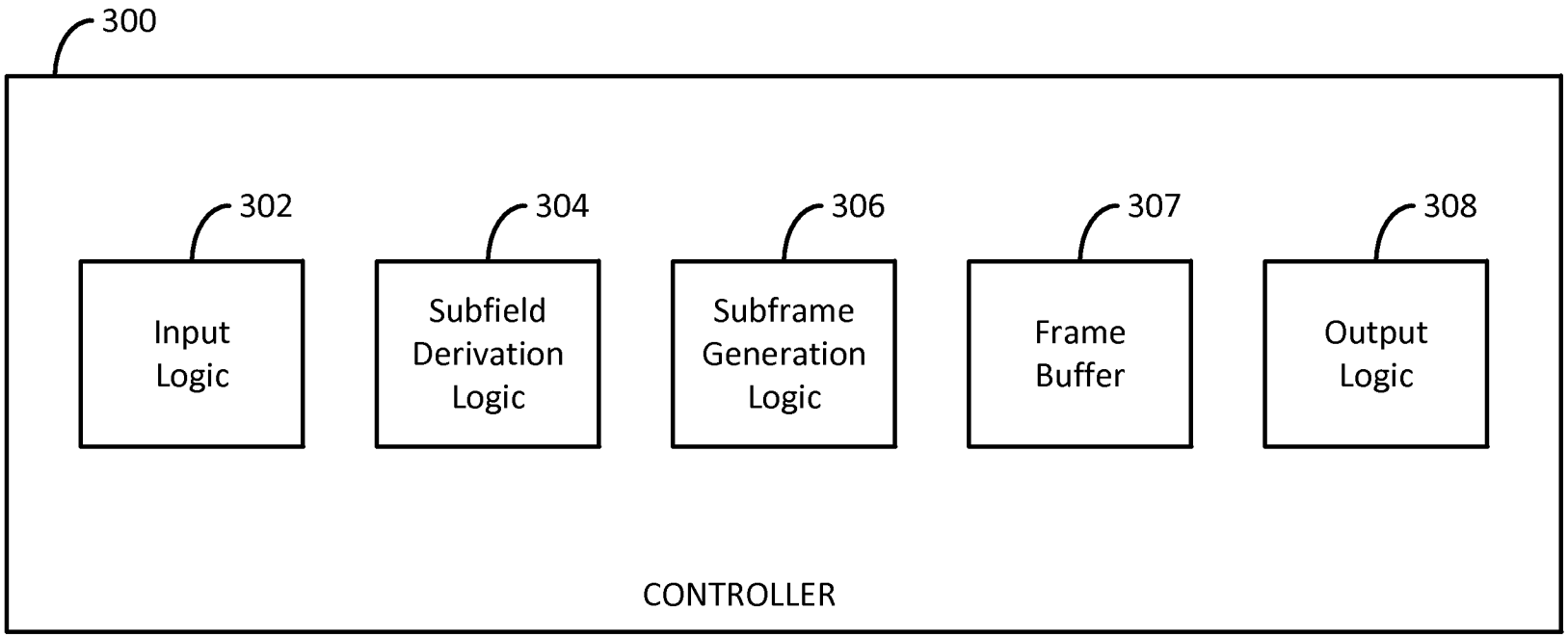
FIG. 3 shows a block diagram of an example architecture for a controller.

FIG. 3 shows a block diagram of an example architecture for a controller 300. For example, the controller 134 shown in FIG. 1B to control the display apparatus 128 may be built according to a similar architecture. In some other implementations, the controller 300 shown in FIG. 3 is implemented in the processor of a host device incorporating a display or in another standalone device that processes data for presentation on a display. The controller 300 includes an input 302, subfield derivation logic 304, subframe generation logic 306, a frame buffer 307, and output control logic 308. Together, the components carry out a process of forming an image.

The input 302 may be any type of controller input. In some implementations, the input is an external data port for receiving image data from an outside device, such as an HDMI port, a VGA port, a DVI port, a mini-DisplayPort, a coaxial cable port, or a set of component or composite video cable ports. The input 302 also may include a transceiver for receiving image data wirelessly. In some other implementations, the input 302 includes one or more data ports of a processor internal to a device. Such data ports may be configured to receive display data over a data bus from a memory device, a host processor, a transceiver, or any of the external data ports described above.

The subfield derivation logic 304, subframe generation logic 306, and the output control logic 308 can each be formed from a combination of integrated circuits, hardware, and/or firm ware. For example, one or more of the subfield derivation logic 304, subframe generation logic 306, and the output control logic 308 can be incorporated into or spread between one or more application specific integrated circuits (ASICs), field programmable gate arrays (FPGAs), or digital signal processors (DSPs). In some other implementations, some or all of the functionality of the subfield derivation logic 304, subframe generation logic 306, and the output control logic 308 may be incorporated into processor executable instructions which, when executed by a processor, such as a general purpose or special purpose processor, cause that processor to carry out the functionality described herein.

The frame buffer 307 can be any form of digital memory with read and write speeds sufficient to store and output image subframes fast enough to accommodate the processes disclosed herein. In some implantations, the frame buffer 307 is implemented as integrated circuit memory, such as DRAM or FLASH memory.

Figure 4:
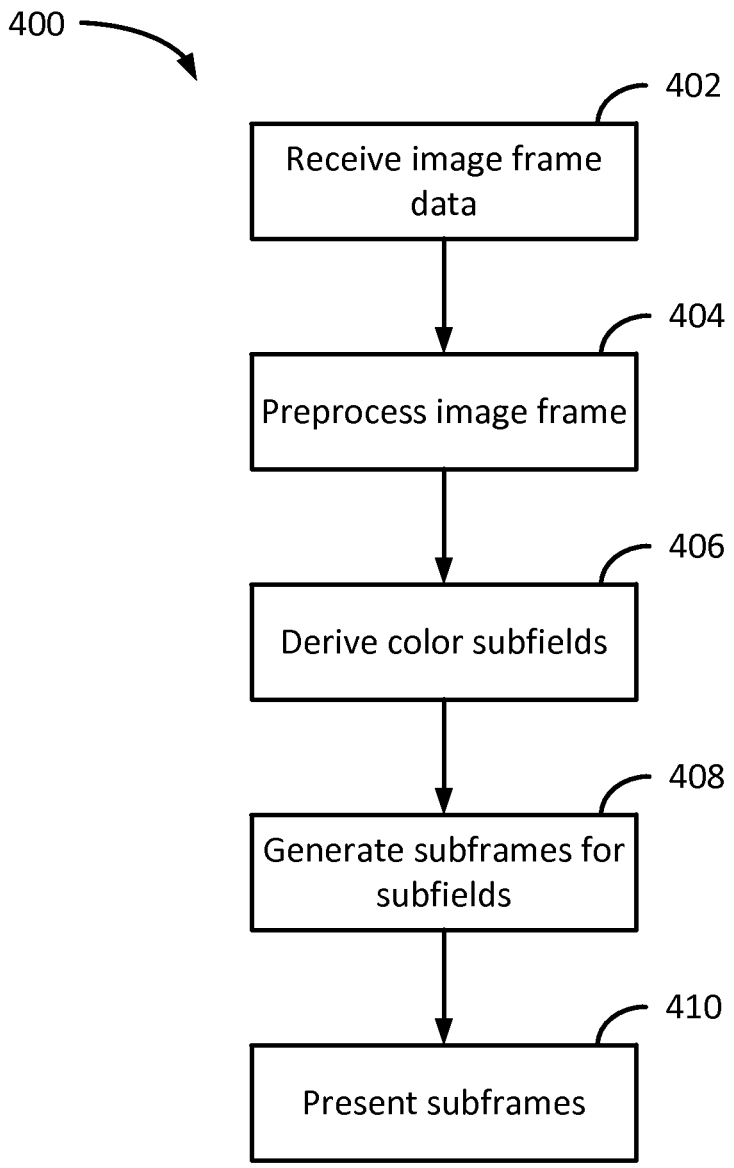
FIG. 4 shows a flow diagram of an example process of forming an image.

FIG. 4 shows a flow diagram of an example process 400 of forming an image. The process includes receiving image frame data (stage 402), preprocessing the image frame (stage 404), deriving color subfields for the image frame (stage 406), generating subframes for each color subfield (stage 408), and presenting the subframes (stage 410) using an array of display elements. Each of these stages, along with the components of the controller 300 shown in FIG. 3 is described further below.

Referring to FIGS. 1, 3 and 4, the input 302 is configured to receive image data for presentation on a display apparatus 128 (stage 402). The image data is typically received as a stream of intensity values for each of a set of input colors, such as red, green and blue, for each pixel in the display apparatus 128. The image data may be received directly from an image source, such from an electronic storage medium incorporated into the display apparatus 128. Alternatively, it may be received from a host processor 122 incorporated into the host device 120 in which the display apparatus 128 is built.

In some implementations, the received image frame data is preprocessed (stage 404) before the remainder of the image formation process 400 proceeds. For example, in some implementations, the image data includes color intensity values for more pixels or fewer pixels than are included in the display apparatus 128. In such cases, the input 302, the subfield derivation logic 304, or other logic incorporated into the controller 300 can scale the image data appropriately to the number of pixels included in the display apparatus 128. In some other implementations, the image frame data is received having been encoded assuming a given display gamma. In some implementations, if such gamma encoding is detected, logic within the controller 300 applies a gamma correction process to adjust the pixel intensity values to be more appropriate for the gamma of the display apparatus 128. For example, image data is often encoded based on the gamma of a typical liquid crystal (LCD) display. To address this common gamma encoding, the controller 300 may store a gamma correction lookup table (LUT) from which it can quickly retrieve appropriate intensity values given a set of LCD gamma encoded pixel values. In some implementations, the LUT includes corresponding RGB intensity values having a 16 bit-per-color resolution, though other color resolutions may be used in other implementations.

In some implementations, the controller 300 applies a histogram function to a received image frame as part of preprocessing the image (stage 404). The histogram function determines a variety of statistics about the image frame that can be used by other components of the controller 300. For example, in one implementation, the histogram function calculates for each FICC the mean intensity of the FICC in the image frame and the proportion of pixels that have an intensity value of 0. This histogram data can be used in selecting a FSCC as is described further below.

The controller 300 also can store a history of histogram data from frame to frame. In one implementation, histogram data from successive image frames are compared to determine if a scene change has occurred. Specifically, if the histogram data for a current frame differs beyond a threshold from the histogram data of a prior image frame, the controller determines that a scene change has occurred, and processes the current image frame accordingly. For example, in some implementations, in response to detecting a scene change, the controller 300 chooses a content adaptive backlight control (CABC) process than it would not use absent a detected scene change.

In some implementations, image frame preprocessing (stage 404) includes a dithering stage. In some implementations, the process of de-gamma encoding an image results in 16 bit-per-color pixel values, even though the display apparatus 128 may not be configured for displaying such a large number of bits per color. A dithering process can help distribute any quantization error associated with converting these pixel values down to a color resolution available to the display, such as 6 or 8 bits per color.

In an example dithering process, the controller calculates for each pixel a difference between its initial larger number of bits representation and its quantized representation for each of the FICCs used by the display. For this example, assume the FICCs are red, green, and blue. The difference calculation can be represented as:

$$\{\Delta R,\Delta G,\Delta B\}=\{R,G,B\}-\{R^Q,G^Q,B^Q\},$$

where $R^Q$, $G^Q$, and $B^Q$ represent the quantized red, green, and blue intensity values for a pixel; R, G, and B represent the unquantized red, green, and blue intensity values; and ΔR, ΔG, and ΔB represent their respective differences. From these difference values, the controller calculates a resultant luminance error value, ΔL, for each pixel. The luminance error, ΔL, can be calculated as follows:

$$\Delta L=\Delta R\times Y_r^{gamut}+\Delta G\times Y_g^{gamut}+\Delta B\times Y_b^{gamut},$$

where $Y_r^{gamut}$, $Y_g^{gamutm}$, and $Y_b^{gamut}$ represent the Y component of the tristimulus values of the red, green, and blue primaries used in the color gamut in which the display is operating. The controller 300 then identifies and applies appropriate increases to each pixel's red, green, and blue intensity values based on the determined luminance errors. In one implementation, the increases are identified using a LUT. After increasing the pixel intensity values based on the LUT, the controller 300 recalculates an updated difference between the pixels' initial unquantized value and their new quantized values. This difference for a pixel can be represented as:

$$\{\Delta R,\Delta G,\Delta B\}=\{R,G,B\}-\{R^Q+LUT_R(\Delta L),G^Q+LUT_G(\Delta L),B^Q+LUT_B(\Delta L)\},$$

where $LUT_R(\Delta L)$, $LUT_G(\Delta L)$, $LUT_B(\Delta L)$ represents the values to increase the red, green, and blue intensities for the pixel obtained from the LUT based on the previously calculated luminance error, ΔL. These new difference values represent luminance better due to the addition of color, but now include color error, which is then distributed among neighboring pixels using an error distribution algorithm. In some implementations, the error is distributed by using a Floyd-Steinberg dithering algorithm using a hard-coded 5×5 kernel. In some other implementations, other kernel sizes, and/or different dithering algorithms or dither masks are employed. As a result, luminance errors resulting from quantization are corrected for by distributing additional luminance to the FICC color channels in a distributed fashion, providing a correction that is particularly challenging for the HVS to detect.

After preprocessing is complete, the subfield derivation logic 304 processes the received image data and converts it into color subfields (stage 406), which will then be displayed to a user to recreate the image encoded in the image data. In some implementations, the subfield derivation logic 304 may dynamically select one or more composite colors to use in addition to the input colors to form any given image frame. A composite color is a color formed from the combination of two or more input colors. For example, yellow is a composite of red and green, and white is a composite of red, green and blue. In some other implementations, the subfield derivation logic 304 is preconfigured to use two or more composite colors in addition to the input colors to form an image. In still some other implementations, the subfield derivation logic 304 is configured to determine for each image frame whether or not to use any composite colors to form the image depending on whether such use would result in a power savings. In each of these implementations, the subfield derivation logic 304 generates for each pixel being displayed a set of intensity values for each color used to form the image (referred to generally as a "contributing color"). Further details about each of these implementations are provided below.

The subframe generation logic 306 takes the color subfields derived by the subfield derivation logic 304 and generates a set of subframes (stage 408) that can be loaded into an array of display elements, such as the array 150 of display elements shown in FIG. 1B, to reproduce the image encoded in the received image data. For a binary display, in which each display element can only be placed into two states, ON or OFF, the subframe generation logic 306 generates a set of bitplanes.

Each bitplane identifies the desired states of each of the display elements in the array for a given subframe. To increase the number of grayscale values that can be achieved with a reduced number of bitplanes, the subframe generation logic 306 assigns each subframe a weight. In some implementations, each bitplane is assigned a weight according to a binary weighting scheme in which each successive subframe for a given color is assigned a weight that is twice that of the subframe having the next lowest weight, for example, 1, 2, 4, 8, 16, 32, etc. In some other implementations, weights are allocated to subframes associated with one or more colors according to a non-binary weighting scheme. Such non-binary weighting schemes may include multiple subframes having the same weight and/or subframes whose weights are more or less than twice the weight of subframe having the next lowest weight.

To generate a subframe (stage 408), the subframe generation logic 306 translates a color intensity value into a binary string of 1s and 0s, referred to as a codeword. The 1s and 0s represent the desired states of a given display element in each subframe for the color for the image frame. In some implementations, the subframe generation logic 306 includes or accesses a LUT that associates each intensity value with a codeword. The codewords for each color for each pixel are then stored in the frame buffer 307.

The output control logic 308 is configured to control the output of signals to a remainder of the components of a display apparatus to cause the subframes generated by the subframe generation logic 306 to be presented to a viewer (stage 410). For example, if used in the display apparatus 128 shown in FIG. 1B, the output control logic 308 would control the output of signals to the data drivers 132, scan drivers 130 and lamp drivers 148 shown in FIG. 1B to load the bitplanes into the display elements in the array 150, and then to illuminate the display elements with the lamps 140, 142, 144 and 146. The output control logic 308 includes scheduling data indicating the times at which each of the subframes generated by the subframe generation logic 308 should be output to the data drivers 132, when the scan drivers 130 should be triggered, and when each of the lamp drivers 148 should be triggered.

Figure 5:
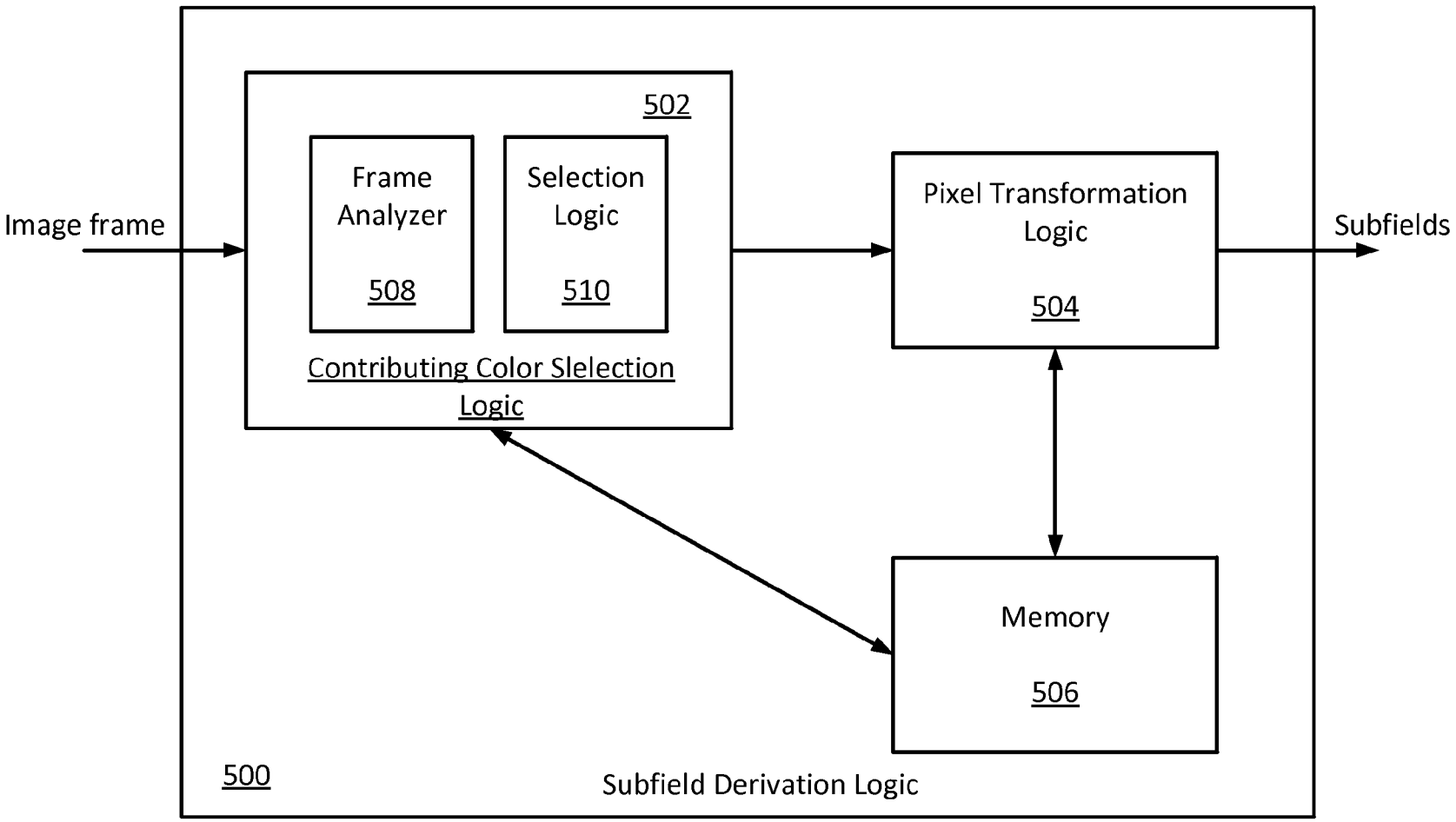
FIG. 5 shows a block diagram of an example subfield derivation logic.

FIG. 5 shows a block diagram of an example subfield derivation logic 500. The subfield derivation logic 500 includes a contributing color selection logic 502, pixel transformation logic 504, and memory 506. The subfield derivation logic 500 is configured to generate a set of color subfields to present to a viewer for each received image frame using a dynamically selected set of FSCCs along with a set of FICCs. One process for deriving such color subfields is shown in FIG. 6.

Figure 6:
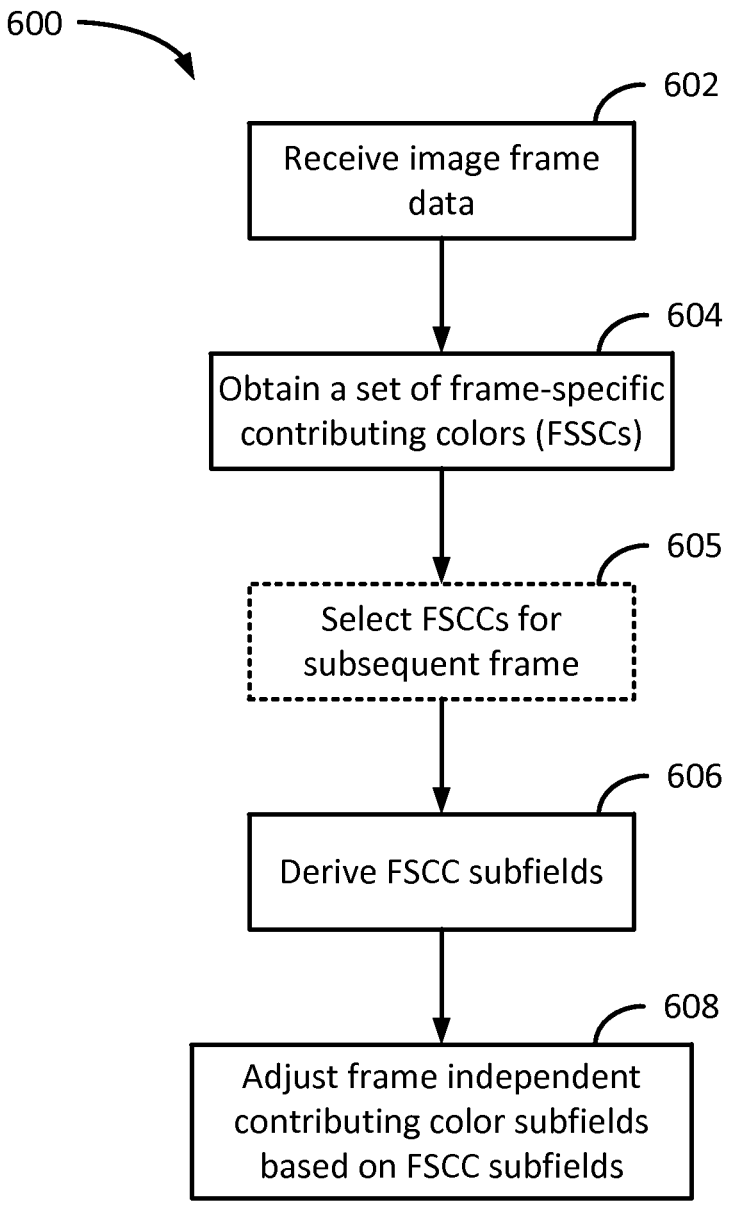
FIG. 6 shows a flow diagram of an example process of deriving color subfields.

FIG. 6 shows a flow diagram of an example process 600 of deriving color subfields. The process 600 may be used to perform stage 406 of the process of forming an image 400 shown in FIG. 4. The process 600 includes receiving an image frame (stage 602), obtaining a set of FSCCs to use in forming the image (stage 604), deriving color subfields for the set of FSCCs for the image frame (stage 606), and then adjusting the color subfields of the FICCs based on the pixel values of the FSCC subfields (stage 608). Each of these stages, as well as the components of the subfield derivation logic 500, is described further below.

Referring to FIGS. 5 and 6, as set forth above, the process of deriving color subfields 600 begins with receiving an image frame (stage 602). The image frame may be received, for example, from the input 302 of the controller 300 shown in FIG. 3. The received image frame is passed to the contributing color selection logic 502.

The contributing color selection logic 502 is configured to obtain a set of FSCCs to use in forming the image (stage 604). In some implementations, the contributing color selection logic 502 is configured to obtain the set of FSCCs to use in forming an image using the image data associated with that image frame. In some other implementations, the contributing color selection logic 502 obtains the set of FSCCs for an image frame based on image data associated with one or more previous image frames. In such implementations, the contributing color selection logic 502 analyzes a current image frame and stores the set of FSCCs to be used in a subsequent image frame (stage 605) in memory 506 and obtains the set of FSCCs to use in the current frame (stage 604) by retrieving from memory 506 the set of FSCCs that was stored based on the prior image frame.

To select a set of FSCCs (either for a current image frame or a subsequent image frame), the contributing color selection logic 502 includes a frame analyzer 508 and selection logic 510. In general, the frame analyzer 508 analyzes an image frame to determine its overall color characteristics, and based on its output, the selection logic 510 selects a set of FSCCs. In some implementations, the frame analyzer 508 can analyze the image frame based on a hue angle-based color space. Example processes by which the contributing color selection logic 502 can select a set of FSCCs are described further below in relation to FIGS. 7-8.

Figure 7:
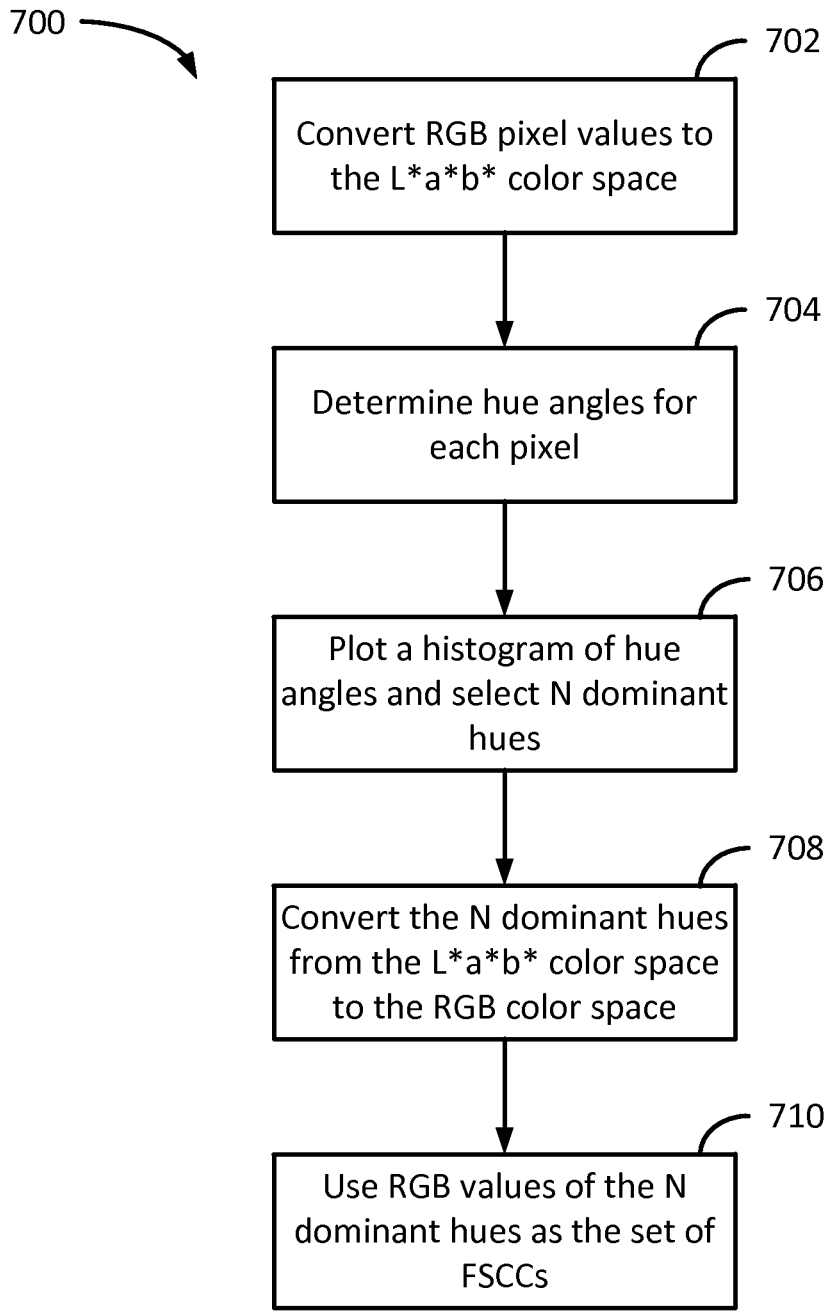
FIG. 7 shows a flow diagram of an example process of selecting a set of frame-specific contributing colors (FSCCs).

FIG. 7 shows a flow diagram of an example process 700 of selecting a set of FSCCs. The FSCC selection process 700 is an example of a FSCC selection process suitable for execution by the contributing color selection logic 502. The process 700 includes converting RGB pixel values to values in the L*a*b* color space (stage 702), determining hue angles for each pixel (stage 704), obtaining a histogram of the hue angles of the colors in the image frame and selecting N dominant hue angles (stage 706), converting each of the N dominant hue angles into corresponding RGB values (stage 708), and using the N RGB values as the set of FSCCs (stage 710).

As set forth above, the process 700 includes converting RGB pixel values of each pixel in the image frame to values in the L*a*b* color space (stage 702). In some implementations, instead of the L*a*b* color space, other hue angle based color spaces such as L*C*h color space, hue-saturation-value (HSV) color space, hue-saturation-lightness (HSL) color space, or any color space based on the Munsell color system. In some implementations, this conversion can be carried out by the frame analyzer 508 shown in FIG. 5. The conversion to the L*a*b* color space is carried out so that the dominant hues in the image frame can be determined As discussed further below, the determination of the dominant hues within the image frame can be used to determine the set of FSCCs.

In some implementations, only a subset of all the pixels in the image frame may be converted to the L*a*b* color space. For example, the contributing color selection logic 502 (shown in FIG. 5) may select pixels having a luminance value greater than the mean or median luminance (or some fraction thereof) of the entire image frame. Pixel values of only these selected pixels may then be converted to values in the L*a*b* color space.

In some implementations, a two-stage process can be used to covert RGB pixel values to values in the L*a*b* color space. First, the RGB pixel values can be converted to XYZ tristimulus values in the XYZ color space. Then, the XYZ tristimulus values can be converted into equivalent values in the L*a*b* color space. In some implementations, RGB pixel values can be analytically converted to their equivalent XYZ tristimulus values. For example, such conversion can be carried out through matrix multiplication of a matrix $$\begin{bmatrix} R \\ G \\ B \end{bmatrix}$$

defined by the RGB pixel values for a pixel with a XYZ transform matrix M, where:

$$M = \begin{bmatrix} X_r^{gamut} & X_g^{gamut} & X_b^{gamut} \\ Y_r^{gamut} & Y_g^{gamut} & Y_b^{gamut} \\ Z_r^{gamut} & Z_g^{gamut} & Z_b^{gamut} \end{bmatrix} = \begin{bmatrix} \frac{x_r^{gamut}}{y_r^{gamut}} S_r & \frac{x_g^{gamut}}{y_g^{gamut}} S_g & \frac{x_b^{gamut}}{y_b^{gamut}} S_b \\ S_r & S_g & S_b \\ \frac{1 - x_r^{gamut} - y_r^{gamut}}{y_r^{gamut}} S_r & \frac{1 - x_g^{gamut} - y_g^{gamut}}{y_g^{gamut}} S_g & \frac{1 - x_b^{gamut} - y_b^{gamut}}{y_b^{gamut}} S_b \end{bmatrix}$$

and $x_r^{gamut}$, $y_r^{gamut}$, and $z_r^{gamut}$ correspond to the XYZ tristimulus values of the red primary of the color gamut being used, $X_g^{gamut}$, $Y_g^{gamut}$, and $Z_g^{gamut}$ correspond to the XYZ tristimulus values of the green primary of the color gamut being used, and $X_b^{gamut}$, $Y_b^{gamut}$, and $Z_b^{gamut}$ correspond to the XYZ tristimulus values of the blue primary of the color gamut being used. Similarly, $x_r^{gamut}$, $y_r^{gamut}$, $x_g^{gamut}$, $y_g^{gamut}$, $x_b^{gamut}$, $y_b^{gamut}$ correspond to the x and y coordinates of the red, green, and blue primaries, respectively, in the CIE color space. $S_r$, $S_g$, and $S_b$ correspond to the relative intensities of the red, green, and blue primaries in relation to the formation of the gamut's white point. The gamut's white point refers to the specific white color employed by the gamut.

Once the pixel values for an image frame are converted to the XYZ color space, the values in the L*a*b* color space can be determined by:

$$\begin{bmatrix} L^* \\ a^* \\ b^* \end{bmatrix} = \begin{bmatrix} 116 f(Y/Y_n) - 16 \\ 500[f(X/X_n) - f(Y/Y_n)] \\ 500[f(Y/Y_n) - f(Z/Z_n)] \end{bmatrix}$$

where $X_n$, $Y_n$ and $Z_n$ are the tristimulus coordinates of the white point in the XYZ color space, and where $$f(t) = \begin{cases} t^{1/3} & t > (6/29)^3 \\ (29/54)^2 t + 4/29 & \text{otherwise} \end{cases}$$

Thus, as described above, the RGB pixel values of the image frame can be converted to values in the L*a*b* color space. In some other implementations, the RGB pixel values may be converted to an intermediate color space other than the XYZ color space before being converted to the L*a*b* color space.

As noted above, the process 700 further includes determining the hue angles for the selected pixels in the image frame (stage 704). In some implementations, the hue angle for a pixel can be determined from the pixel value in the L*a*b* color space. Specifically, the hue angle θ can be determined by $$\theta = \tan^{-1}(b^*/a^*).$$

In some other implementations, a look-up-table may be employed to directly convert the RGB pixel values into their corresponding values in the L*a*b* color space. In some such implementations, the contributing color selection logic 502 may generate and store an RGB-L*a*b* look-up-table (LUT). RGB pixel values and the corresponding hue angles can be used to populate the RGB-L*a*b* LUT. In some implementations the RGB-L*a*b* LUT can store information relating hue angles to RGB pixel values. In some implementations, as described below, the RGB-L*a*b* LUT, or another LUT derived from it, can be utilized for converting dominant hue angles back into pixel values in the RGB color space. In some implementations, the values stored in the RGB-L*a*b* LUT can be experimentally determined Once the hue angles for selected pixels in the image frame have been determined, the process 700 proceeds with obtaining a histogram of the hue angles of the colors in the image frame and selecting N dominant hues (stage 706). In some implementations, the histogram of hue angles of all the pixels in the image frame may be obtained. In some other implementations, the histogram of hue angles of only the selected pixels, which have a luminance value greater than the mean or median luminance (or some fraction thereof) of the entire image frame, may be obtained. The histogram can provide information on the distribution of hues within the image frame. As such, the histogram includes a measure of occurrences of hue angles within the image frame.

Figure 8:
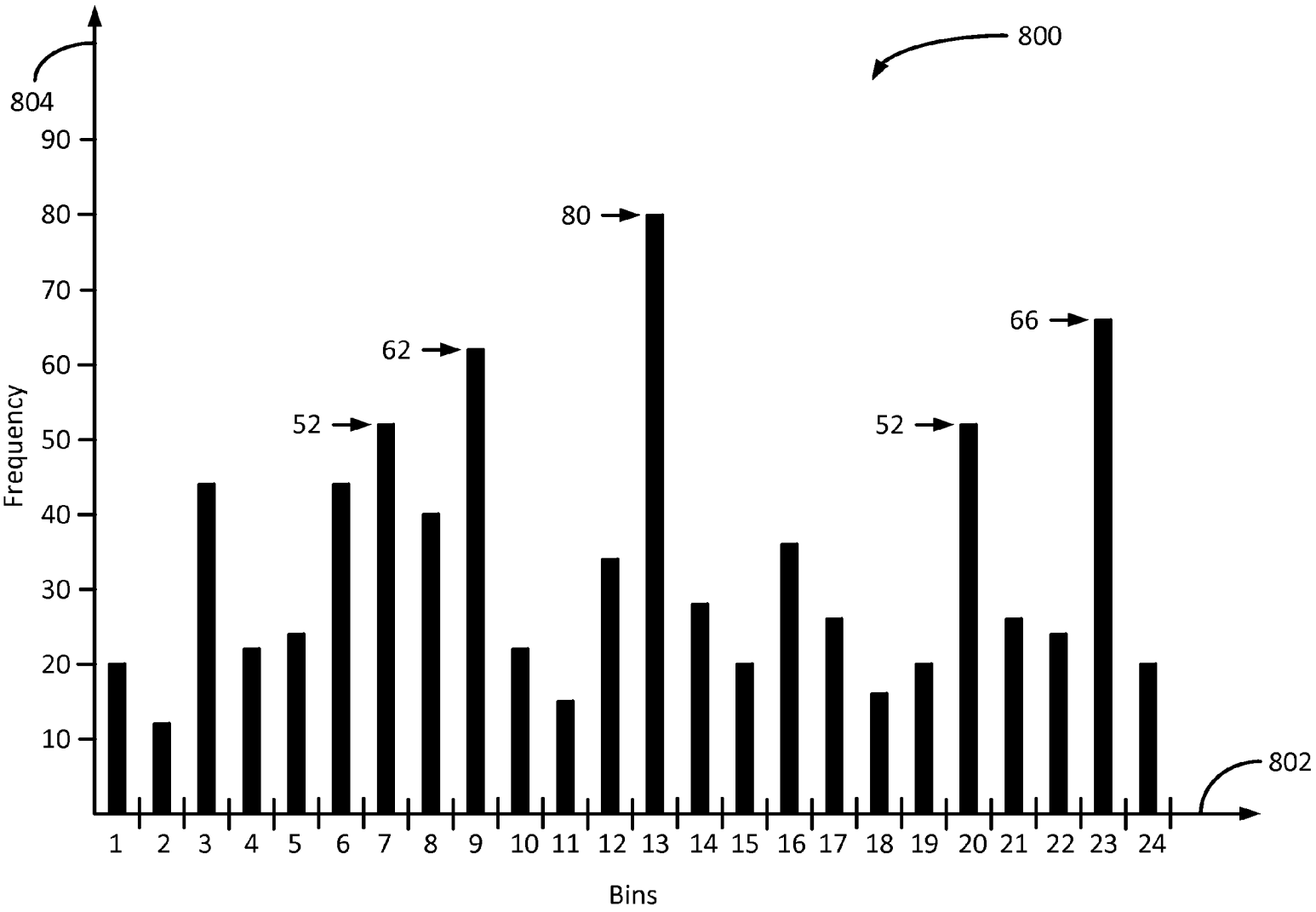
FIG. 8 shows an example histogram of hue angles of an image frame.

FIG. 8 shows an example histogram 800 of hue angles of an image frame. The horizontal axis 802 of the histogram represents various bins (numbered from 1 to 24), where each bin represents a subset of the entire range of hue angles. Typically, the entire range of the hue angles can be about 2π radians. In some implementations, the hue angles can have values between 0 radians to 2π radians. In some other implementations, the hue angles can have values between −π radians to π radians. In some implementations, the range can be equally divided among the 24 bins. In some other implementations, the range can be un-evenly divided among the 24 bins. The number of bins is not limited to that shown in FIG. 8. In some implementations, a larger number of bins may be used to improve the precision of the dominant hue(s) determination. In some other implementations, the number of bins may be decreased to reduce the time, memory, and/or processing power needed to generate and process the histogram 800. In some other implementations, the number of bins used may be adjusted based on the distribution of the hue angles within the current image frame and/or one or more previous image frames. In some implementations, the number of bins can be equal to 16, 32, 41, 50, 100, etc., or any other integer greater than N.

The vertical axis 804 of the histogram 800 represents the frequency with which hue angles of pixels in the image frame occur within each bin. The frequency in each bin is represented by a rectangle, where the height of the rectangle indicates the frequency in the bin. For example, the height of the rectangle for bin-7 is 52. This means that about 52 of the selected pixels in the image frame have hue angles in the hue angle range represented by bin-7. The dominance of a hue range in the image frame is indicated by how frequently hue angles belonging to that hue range occur in the image frame. Thus, the height of the rectangle for a bin indicates the dominance of a hue range associated with the bin. For example, the hue range associated with the bin-13 is the most dominant because the height (80) of the rectangle for bin-13 is the greatest among all rectangles in the histogram 800. Once the dominant hue range is determined, a hue angle can be selected from the selected bin.

In some implementations, to determine the N most dominant hue angles, the contributing color selection logic 502 may first determine the N most dominant hue ranges. Then, one hue angle from each of the N dominant hue ranges can be selected as one of the N dominant hue angles. The N most dominant hue ranges can be determined from the histogram 800 by determining the N highest frequencies and then selecting the bins associated with those frequencies. For example, if N=1, then 80 is the highest frequency and bin-13 would be selected; if N=2, then 80 and 66 are the two highest frequencies and bin-13 and bin-23 would be selected; if N=3, then 80, 66, and 62 are three highest frequencies, and bin-13, bin-23, and bin-9 would be selected; and so on.

In some instances, more than one bin may have the same associated frequency. For example, if N=4, then 80, 66, 62, and 52 are the four highest frequencies, but two bins, bin-7 and bin-20 have the same frequency 52. Thus, even though N=4, there are 5 bins that qualify for selection. In some implementations, the contributing color selection logic 502 can arbitrate and select one of bin-7 and bin-20. In some implementations, the arbitration can include randomly selecting one of bin-7 and bin-20. In some other implementations, the arbitration can include identifying the frequencies of the bins adjacent to the two bins, and selecting the bin with higher aggregate bin frequencies across the bins. For example, the contributing color selection logic 502 can identify bin-6 and bin-8, and bin-19 and bin-21 as adjacent bins to bin-7 and bin-20, respectively. As the aggregate frequency of bins 6-8 is greater than the aggregate frequency of bins 19-21, bin-7 may be selected over bin-20.

In some implementations, the contributing color selection logic 502 can determine the N dominant bins by first identifying N groups of non-overlapping consecutive bins and then selecting one bin from each of the N groups. For example, for N=3 the contributing color selection logic 502 can identify bins 1-8 as a first group, bins 9-16 as the second group, and bins 17-24 as the third group. The bin with the highest frequency within each group can then be selected as one of the three dominant bins. For example, bin-7, bin-13, and bin-23 are the bins with the highest frequencies within the first, second, and third group, respectively. Therefore, bin-7, bin-13, and bin-23 can be selected as the three most dominant bins.

In some implementations, the histogram 800 may be processed using a peak-detection algorithm to determine the peaks in the histogram 800. In some implementations, a line or curve fitting process can be applied to the frequency values of the bins and the peaks can be found in the resulting line or curve. In some such implementations, the contributing color selection logic 502 may select the N bins corresponding to the N highest peaks determined by the peak-detection algorithm.

In some implementations, contributing color selection logic 502 may impose a minimum hue angle separation between any two potential dominant bins. For example, in the process of selecting N dominant bins, the contributing color selection logic 502 may select only those N most dominant bins, any two of which are separated by at least the minimum hue angle. For example, the contributing color selection logic 502 may select only those dominant hue ranges which are separated by at least 3 bins. In some such implementations, in which N=4, the selected bins would be bin-13, bin-23, bin-9 and bin-20. Bin-7 would be excluded because it is only 2 bins away from bin-9.

As mentioned above, one hue angle can be selected from each of the identified N dominant bins to determine the N dominant hue angles. In some implementations, the contributing color selection logic 502 may select a hue angle at the center of the hue angle range associated with a selected bin. In some other implementations, the median of the hue angles within the hue angle range associated with the selected bin may be selected. In some such implementations, the median can be determined from a distribution of the hue angles within the hue angle range associated with the selected bin. In some other implementations, the selected bin may be associated with a pre-selected hue angle within its corresponding range, which is selected as the dominant hue angle when that bin is identified as one of the N dominant bins.

Once N dominant hue angles have been determined, the contributing color selection logic 502 can convert the N dominant hue angles into N intensity values in the RGB color space. As discussed above, the hue angle is a function of a ratio of a* to b* in the L*a*b* color space. As such, several values of a* and b* can result in the same hue angle. Furthermore, the hue angles lack information regarding the lightness, or L* values. Therefore an analytical conversion from the N dominant hue values to N equivalent intensity values in the RGB color space may not be feasible. In some implementations, a look-up-table stored by or accessible to the contributing color selection logic 502 can be utilized to convert the N dominant hue angles into corresponding N intensity values in the RGB color space. For example, the RGB—L*a*b* LUT (or one derived from it), discussed above, can be utilized to provide intensity values in the RGB color space for various hue values.

Once the N RGB intensity values corresponding to the N dominant hue angles or N dominant bins have been determined, the contributing color selection logic 502 can use these N RGB intensity values as the set of FSCCs (stage 710). As mentioned above, the set of FSCCs can be utilized in generating FSCC subfields. The FSCC subfields, in turn, can be utilized in adjusting FICC subfields of the image frame.

Referring back to FIGS. 5 and 6, in implementations in which the subfield derivation logic 500 determines a set of FSCCs to use for a subsequent image frame based on a current image frame, the subfield derivation logic 500 retrieves a previously stored set of FSCCs from memory 506 and stores the newly selected set of FSCCs back to memory 506 (stage 605). In implementations in which subfield derivation logic 500 uses a set of FSCCs for a current image frame based on the data included in the current image frame, the subfield derivation logic 500 proceeds directly with the subsequent stage of the subfield derivation process 600 using the set of FSCCs selected by the contributing color selection logic 502.

Still referring to FIGS. 5 and 6, assuming the contributing color selection logic 502 obtained a set of FSCCs to use for the image frame (either from memory or based on the current image frame), the subfield derivation logic 500 proceeds with deriving a FSCC subfield for each FSCC belonging to the set of FSCCs (stage 606). In some implementation, the pixel transformation logic 504 of the subfield derivation logic 500 creates the FSCC subfields iteratively, one FSCC subfield at a time. For example, for each FSCC, the subfield derivation logic 500 can identify FSCC intensity values, store the FSCC values in an FSCC subfield, and update the FICC subfields based on the identified FSCC intensity values. In some implementations, the FSCC subfields may be derived in the order of the relative dominance of the hue angles identified in the selection of the FSCCs.

In some implementations, the FSCC intensity values are identified to be intensity values that corresponds to the maximum light intensity that could be output for each pixel using the FSCC without altering the chromaticity of the pixel. Such an FSCC subfield derivation strategy is referred to as "maximum replacement strategy," and the values resulting from such a strategy are referred to as "maximum replacement intensity values." In some other implementations, the subfield derivation logic 500 employs a different strategy in which, for each pixel, only a fraction of the maximum replaceable intensity values are allocated to an FSCC subfield. For example, the subfield derivation logic 500, in some implementations, assigns an intensity to each pixel in the FSCC subfield equal to between about 0.5 and about 0.9 times the maximum replacement intensity value for that pixel, though other fractions less than about 0.5 and between about 0.9 and 1.0 also can be employed. This strategy is referred to as a fractional replacement strategy.

As indicated above, as the FSCC subfields are derived (stage 606), the pixel transformation logic 504 of the subfield derivation logic 500 adjusts the FICC subfields based on the FSCC subfields (stage 608). Depending on the FSCCs selected, two or more of the FICC subfields may need to be adjusted. More particularly, the pixel transformation logic 504 adjusts the pixel intensities of the FICC subfields associated with the FICCs that combine to form each of the set of FSCCs. For example, assume the FICCs include red, green and blue. If Cyan was selected as an FSCC, the pixel transformation logic 504 would adjust the pixel intensity values for the blue and green subfields. If yellow was selected as an FSCC, the pixel transformation logic 504 would adjust the pixel intensity values of the red and green subfields. If white, or any other color spaced away from the edge of the RGB color gamut, was selected as an FSCC, the pixel transformation logic 504 would adjust the pixel intensity values of all three FICC subfields.

Represented mathematically, for a pixel having initial FICC intensity values of R, G, and B for a pixel n, the pixel transformation logic 504 sets updated intensity values R', G', and B' in the respective FICC subfields as follows:

$$\begin{bmatrix} R' \\ G' \\ B' \end{bmatrix} = \begin{bmatrix} R \\ G \\ B \end{bmatrix} - \sum_n x_n \begin{bmatrix} x_{nR} \\ x_{nG} \\ x_{nB} \end{bmatrix},$$

where $x_n$ is the FSCC intensity value for the pixel n, and $x_{nR}$, $x_{nG}$, and $x_{nB}$, are the relative intensity values of each FICC (Red, Green, and Blue, respectively) in the FSCC.

The initial FICC subfields are derived from the image data for the image frame received from the controller input 302 shown in FIG. 3, after any preprocessing that may have been necessary (see stage 404 shown in FIG. 4) has been completed. To adjust the FICC subfields, the pixel transformation logic 504 starts with the initial FICC subfields and subtracts from the intensity values for each pixel in the corresponding FICC subfields the intensity of that FICC used to generate the respective pixel intensity for the pixel in the FSCC subfield.

Consider the following example for a single pixel, where the contributing color selection logic 502 has selected magenta and yellow as the two FSCCs. Assume the intensity values for the pixel in the FICC subfields are Red 200, Green 100 and Blue 50. Magenta is formed from equal parts of green and blue. Thus, if maximum replacement strategy were utilized, the pixel transformation logic 504 would assign a value of 50, the highest value that can be equally subtracted from the green and blue fields, to the magenta subfield for the pixel. This would also result in the green and blue subfields to be accordingly adjusted to result in the FICC subfields intensity values of Red 200, Green 150 and Blue 0. The pixel transformation logic 504 would then proceed to adjust the FICC subfields based on the second FSCC, yellow. Yellow is formed from equal parts of red and green. Thus, if a maximum replacement strategy were utilized, the pixel transformation logic 504 would assign a value of 150, the highest value that can be equally subtracted from the red and green subfields, to the yellow subfield for the pixel. It would then reduce the values in the red and green subfields for that pixel accordingly to Red 50 and Green 0.

Thus, the pixel transformation logic 504 can iteratively adjust the FICC subfields for each FSCC. In some implementations, the order in which the FSCCs are selected from the set of FSCCs for iteratively adjusting the FICC subfields may be based on a relative degree of dominance of the FSCCs in the image frame. For example, the FSCC with the greatest relative degree of dominance can be selected first to adjust the FICC subfields, while the FSCC with the smallest relative degree of dominance can be selected last. The relative degree of dominance of an FSCC can be determined from the relative degree of dominance of the corresponding hue angle or the corresponding hue angle range in the L*a*b* space. For example, if three FSCCs were selected, referring to the histogram 800 of FIG. 8, the FSCC corresponding to the hue range represented by bin-13 may be denoted as having the greatest degree of dominance, while the FSCC corresponding to hue range represented by bin-9 may be denoted as having the least degree of dominance among the selected FSCCs.

In some other implementations, a reduced-subframe replacement strategy is used to allocate pixel intensity values to the FSCC subfields. In such implementations, the controller in which the subfield derivation logic 500 is incorporated is configured to generate fewer subframes for the FSCCs than for the FICCs. That is, the controller displays FICCs using a full complement of bitplanes having relative weights beginning at 1 and ranging up to 64 or 128. However, for the N FSCC subfields, the controller only generates and causes to be displayed a limited number of higher weighted subframes. The FSCC subframes in each of the N FSCC subfields are generated with higher weights to maximize the luminance replacement provided by the respective FSCC, without employing a larger number of additional subframes.

For example, in some implementations, the controller is configured to generate between 4-8 subframes for each of the FICC subfields and only 2 or 3 higher weight subframes for each of the FSCC subfields. In some other implementations, the controller is configured to generate 4 lower weight subframes for each of FICC subfields and only 3 higher weight subframes for each of the FSCC subfields. In some implementations, the weights of the FSCC subframes are selected from the highest significance weights of a binary sub-frame weighting scheme. For an 8-bit-per-color gray scale process, the controller would generate three FSCC subframes having weights of 32, 64 and 128 for each of the N FSCC subfields. The weights of the subframes for the FICCs may or may not be assigned according to a binary weighting scheme. For example, the subframe weights for the FICCs may be selected to include some degree of redundancy to allow multiple representations of at least some gray scale values. Such redundancy aids in reducing certain image artifacts, such as dynamic false contouring ("DFC"). Thus, the controller may utilize 3 or 4 subframes to display an 8-bit FICC value.

In some implementations, the number of subframes generated for each of the FICC subfields and the each of the FSCC subfields can be dynamically varied. In some such implementations, the number of subframes generated can be a function of the energies within the FSCC subfields and the energy in the adjusted FICC subfields. In some implementations, the energy within a subfield can be determined by adding the intensity values of the pixels in the subfield. In some implementations, if the sum of the energies within the FSCC subfields is greater than the sum of energies in the adjusted FICC subfields, then more subframes can be re-allocated to display the FSCCs subfields. On the other hand, if the sum of energies within the FSCC subfields is less than the sum of energies within the FICC subfields, then more subframes can be re-allocated to display the FICC subfields.

In implementations in which fewer FSCC subframes are used, the pixel transformation logic 504 cannot assign intensity levels to the FSCC subfields with as high granularity as it does in implementations in which it employs a full complement of FSCC subframes. Thus, when determining the FSCC intensity levels for the pixels in a FSCC subfield, the pixel transformation logic 504 assigns each pixel a value equal to the maximum FSCC intensity that could be used to replace FICC light intensity, and then rounds the value down to the closest intensity level that can be generated given the reduced number of subframes and their corresponding weights.

Consider a pixel having FICC intensity values of Red 125, Green 80, and Blue 20 being processed by a controller that uses FSCC subframe weights of 128, 64, and 32. In this example, assume the contributing color selection logic 502 selects Yellow as one of the FSCCs. The subfield derivation logic 206 would identify a maximum replacement value for Red and Green as 80. It would then assign an intensity value of 64 for the pixel in the yellow subfield, as 64 is the maximum intensity of yellow that can be displayed using the above-referenced weighting scheme without providing a greater intensity of yellow than exists in the pixel.

Consider another example in which a pixel has FICC values of Red 240, Green 100, and Blue 200. In this case, assume white is selected as one of the FSCCs. Given the FSCC subframe weights of 32, 64 and 128, the pixel transformation logic 504 selects a FSCC intensity value of 96, the highest common intensity level shared by each of the FICCs that can be generated using the available FSCC subframe weights. Thus, the pixel transformation logic 504 sets the FSCC and FICC color subfield values for the pixel to be Red 154, Green 4, Blue 154 and White 96.

While using a reduced number of subframes for FSCCs may reduce the load on the display to generate extra subframes, it does pose the risk of causing DFC when displaying neighboring pixels having similar overall colors, but which are displayed using different FSCC values. For example, DFC might arise when displaying neighboring pixels having respective maximum replacement intensity values of 95 and 96 such as for colors Red 95, Green 95, and Blue 0 and Red 96, Green 96, and Blue 0. Assuming one of the FSCC is yellow, the first pixel would be displayed using a FSCC intensity of 64 and red blue and green intensities of Red 31, Green 31, and blue 0, respectively. The second pixel would be displayed with a FSCC intensity of 96 and red, green, and blue intensities of Red 0, Green 0, Blue 0. This significant difference in the FSCC color channel coupled with the significant differences in the red and green channels can be detected by the HVS, resulting in a DFC artifact.

The FSCC and FICC derivation processes described above can faithfully reproduce an image encoded in the image data in a received image. However, in some implementations, the subfield derivation logic of a controller is configured to generate subfields which, when displayed, intentionally result in a displayed image that differs from the input image data. For example, in some implementations, subfield derivation logic can be configured to generate image frames that generally have a higher luminance than indicated in a received image frame.

In one such implementation, after a FSCC subfield is generated using the reduced-subframe replacement strategy described above, a scaling factor M is derived and applied when adjusting each of the pixel values in the FICC subfields based on the FSCC subfield. The scaling factor for a pixel can be calculated as a function of a saturation parameter, a minimum pixel luminance value, $Y_{min}$, and a maximum pixel luminance value, $Y_{max}$. The saturation parameter can be derived from the degree of subframe reduction used in generating each of the FSCC subfields.

The new pixel intensity values, R', G', and B' for a pixel are then calculated by scaling the original FICC pixel values, R, G, and B, using the scaling factor, M, and subtracting out the intensity of each FICC in each of the FSCC channel subfields. These intensity values are in turn equal to the product of the FSCC intensity value for the pixel, $x_n$, and the relative intensity values of each FICC in the FSCC, i.e., $x_{nR}$, $x_{nG}$, and $x_{nB}$. That is:

$$\begin{bmatrix} R' \\ G' \\ B' \end{bmatrix} = \begin{bmatrix} 1+M & 0 & 0 \\ 0 & 1+M & 0 \\ 0 & 0 & 1+M \end{bmatrix} \cdot \begin{bmatrix} R \\ G \\ B \end{bmatrix} - \sum_n x_n \begin{bmatrix} x_{nR} \\ x_{nG} \\ x_{nB} \end{bmatrix}$$

In some implementations, to help mitigate the DFC potentially arising from using only higher weighted subframes for the FSCC subframes, the pixel transformation logic 504 modifies the FSCC subfield by applying a spatial dithering algorithm to the FSCC subfield prior to updating the FICC subfields. The spatial dithering distributes any quantization error associated with using the reduced number of higher-weighted subframes. Various spatial dithering algorithms, including an error diffusion algorithm (or variants thereof) can be used to effect the dithering. In some other implementations, block quantization and ordered dithering algorithms may be employed, instead. In yet other implementations, integrated dither, vector error diffusion or vector dithering algorithms may be employed. The intensity values of the pixels in the FICC subfields are then calculated accordingly based on the dithered FSCC subfields.

Some implementations of subfield derivation logic, similar to the subfield derivation logic 500 shown in FIG. 5, also incorporate CABC logic. In such implementations, after the FSCC subfields and FICC subfields are derived, the CABC logic normalizes the intensity values in one or more of the subfields such that the maximum intensity value in each normalized subfield is scaled to the maximum intensity value output by the display. For example, in a display capable of outputting 256 gray scale levels, the subfield values are scaled such that the maximum intensity value therein is equal to 255. The subfield derivation logic 500 then outputs corresponding normalization factors to the output control logic of the apparatus in which it is incorporated such that the illumination levels of the corresponding LEDs are adjusted accordingly. An example of subfield derivation logic that incorporates CABC logic is shown in FIG. 9.

Figure 9:
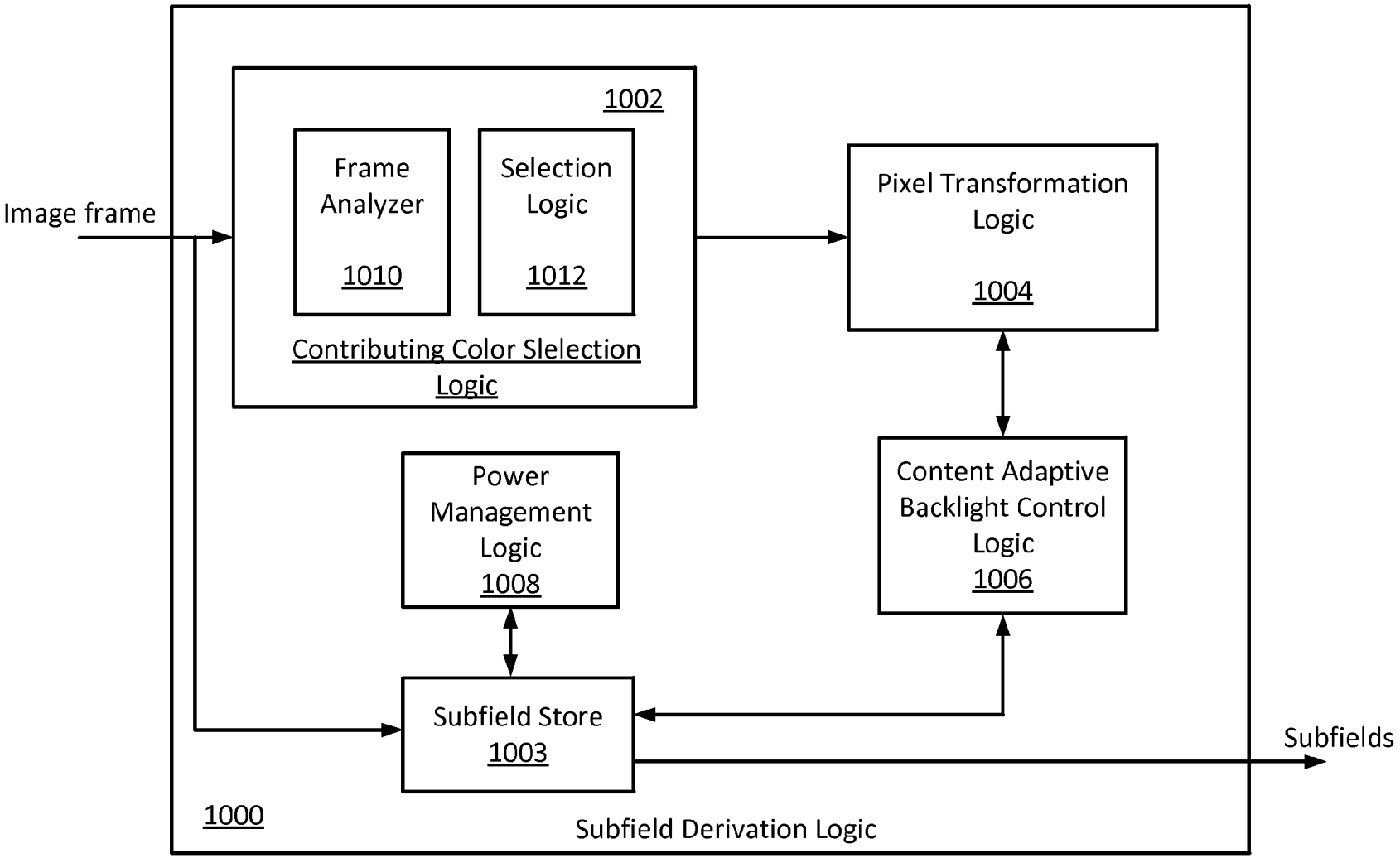
FIG. 9 shows a block diagram of a second example subfield derivation logic.

FIG. 9 shows a block diagram of a second example subfield derivation logic 1000. The subfield derivation logic 1000 includes contributing color selection logic 1002, a subfield store 1003, pixel transformation logic 1004, CABC logic 1006 and power management logic 1008. Together, the components of subfield derivation logic 1000 function to carry out a process of forming an image, such as the process shown in FIG. 10. The functionality of each of the components will be described below in relation to the description of FIG. 11.

Figure 10:
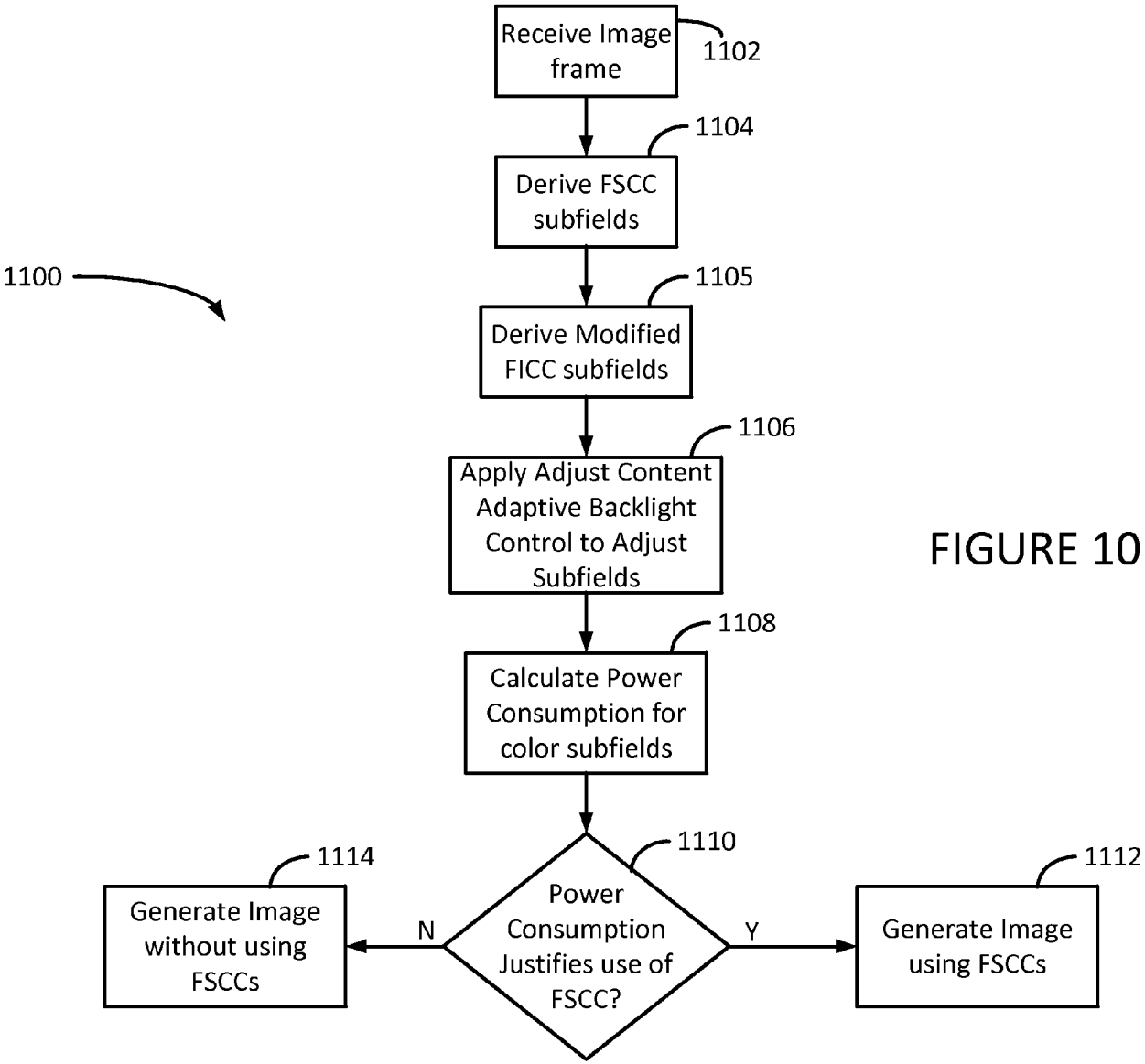
FIG. 10 shows a flow diagram of another example process of forming an image.

FIG. 10 shows a flow diagram of another example process 1100 of forming an image. The image formation process 1100 utilizes CABC approach along with additional power management techniques. The power management functionality determines for each frame whether to form an image using the set of FSCCs, or whether to use only FICCs, depending on the relative power consumption associated with each option. The process 1100 includes receiving an image frame (stage 1102), deriving the set of FSCC subfields based on the received image frame (stage 1104), deriving modified FICC subfields based on the FSCC subfields (stage 1105), applying CABC (stage 1106), calculating the power consumption associated with presenting the image using only FICCs and using a combination of FICCs and FSCCs (stage 1108). The process 1100 further includes determining whether using the set of FSCCs to generate the image is justified based on the relative power consumption of the two options (stage 1110). If use of the FSCC is justified, the process proceeds with forming the image using the set of FSCCs (stage 1112). Otherwise, the process continues to form the image using only FICCs (stage 1114).

Referring to FIGS. 9 and 10, the process 1100 begins with the receipt of an image frame (stage 1102). The subfield derivation logic 1000 receives the image frame from the input of the apparatus in which the subfield derivation logic 1000 is incorporated. In some implementations, the received image frame is preprocessed prior to its receipt at the subfield derivation logic 1000. In other implementations, the subfield derivation logic includes an additional preprocessing logic block to preprocess the image frame. For example, the preprocessing logic may apply a scaling or gamma correction algorithm to the received image frame to adapt it to the particular specifications of the display in which it is incorporated. The image frame is then passed to the contributing color selection logic 1002 and to the subfield store 1003. The subfield store 1003 stores the image frame as a set of FICC color subfields formed form the input data. In some implementations, the subfield store 1003 is part of a frame buffer shared among other components of the apparatus in which the subfield derivation logic 1000 is incorporated, such as the frame buffer 307 of the apparatus 300 shown in FIG. 3. In some other implementations, the subfield store 1003 is a separate memory device or a separate partition of a shared memory device.

The contributing color selection logic 1002 carries out substantially the same functionality as the contributing color selection logic 502 shown in FIG. 5. The contributing color selection logic 1002 includes a frame analyzer 1010 and selection logic 1012 which together analyze a received image frame and select a set of FSCCs to use for presenting the image, respectively. The contributing color selection logic 1002 may implement any of the current image frame or subsequent image frame FSCC selection techniques described above.

After a set of FSCCs is selected, the pixel transformation logic 1004 processes the image frame using the selected FSCCs to derive FSCC subfields (stage 1104). The pixel transformation logic 1004 may derive the FSCC subfields using any of the FSCC subfield generation techniques described above, including without limitation, using the maximum replacement strategy, a fractional replacement strategy, or a reduced-subframe replacement strategy (with or without dithering). The pixel transformation logic 1004 then derives modified FICC subfields based on the FSCC subfields (stage 1105). The pixel transformation logic 1004 derives new FICC subfields instead of modifying the original FICC subfields such that the power consumption associated with displaying the image frame with and without the set of FSCCs can be compared, as described further below.

Once the new FICC subfields are derived (stage 1105), the CABC logic 1008 processes the FSCC subfields and the new FICC subfields, as well as the original FICC subfields as described above (stage 1106). Processing the FSCC subfields and the new FICC subfields includes normalizing the respective subfields. CABC logic 1006 normalizes the intensity values of one or more subfields such that the maximum intensity value in each subfield is scaled to the maximum intensity value output by the display. The scaling factor is the communicated to the output control logic for adjusting the illumination levels of the corresponding LEDs. The normalized subfields may then be saved into the subfield store 1003. In some implementations, the CABC logic 1008 processes the original FICC subfields before processing the derived subfields. For example, the CABC logic 1008 can process the original FICC subfields while the other components of the subfield derivation logic 1000 are selecting the set of FSCCs and deriving the FSCC subfields.

The power management logic 1010 is configured to determine whether to display the image using the selected set of FSCCs or to just use the FICCs. Doing so includes two stages. First, the power management logic 1010 processes the CABC processed subfields to determine the power that would be consumed, hypothetically, if the image frame were presented with and without the FSCC subfields (stage 1108). Then, the power management logic 1010 compares the respective power consumptions and determines whether or not the use of the set of FSCCs is justified (stage 1110) based on the comparison.

In the simple case, the power management logic 1010 determines to use the set of FSCCs to generate an image frame if doing so saves power. However, use of the FSCCs, while in some cases potentially requiring additional power, also can help reduce certain image artifacts, such as color breakup (CBU). Thus in some implementations, the power management logic 1010 determines to use the set of FSCCs even if doing so consumes some amount of power more than would be consumed using only FICCs. This determination can be generalized as follows:

$$DisplayMode = \begin{cases} RGBx, & \beta P_{RGBx} < P_{RGB} \\ RGB, & \text{Otherwise} \end{cases},$$

where RGBx refers to displaying the image frame using the set of FSCCs, RGB refers to displaying the image frame using only FICCs, $\beta \leq 1$, $P_{RGB}$ is the power that would hypothetically be consumed if the image frame were displayed using only FICCs, and $P_{RGBx}$ is the power that would hypothetically be consumed if the image frame were displayed using the set of FSCCs.

Power savings are more likely achieved when the dominant FSCC is white and the display includes a white LED to generate the white light. This is a result of the substantially higher efficiency of white LEDs in comparison to LEDs that generate saturated colors. However, the use of FSCCs other than white may still provide power advantages due to the ability to shift some of the intensity associated with one or more FICCs into the FSCC subfield, and through the use of CABC, enable the display to illuminate those FICCs at a substantially lower intensity.

Generally speaking, the power consumed in displaying an image (either $P_{RGRx}$ or $P_{RGB}$) can be broken down into two primary components, addressing power consumption ($P_a$) and illumination-related power consumption ($P_i$), with the latter typically dwarfing the former.

$P_i$ resulting from display of an image frame using only the FICCs red, green, and blue, i.e., $P_{iRGB}$, can be calculated as follows:

$$P_{iRGB}=P_{iR}+P_{iG}+P_{iB},$$

where $P_{iR}$ corresponds to the power consumed in illuminating a set of red subframes, $P_{iG}$ corresponds to the power consumed in illuminating a set of green subframes, and $P_{iB}$ corresponds to the power consumed in illuminating a set of blue subframes.

$P_i$ resulting from display of an image frame using only a FSCC, i.e., ($P_{iRGBx}$, where x represents the set of FSCCs), can be calculated as follows:

$$P_{iRGBx}=P_{iR}+P_{iG}+P_{iB}+P_{ix},$$

where $P_{ix}$ corresponds to the power consumed in illuminating the set of FSCCs.

The power consumed for a color is a function of the power curve of the LEDs used generate the color, the intensity of the LEDs, and the total duration of illumination of the color across the subframes used to illuminate the subfield. The intensity of the LEDs is a function of the gray scale process being employed, the normalization factor for the color determined during the CABC process, and for FSCCs or any other composite color, the relative intensities of each color used in forming the composite color. Using the above parameterization, the power management logic 1010 can compute the hypothetical (or theoretical) power consumption associated with displaying in an image both with and without the use of FSCCs.

If, based on the power computations described above, the power management logic 1010 deems use of the set of FSCCs justified (at stage 1110), i.e., that $\beta P_{RGBx}<P_{RGB}$, the controller in which the subfield derivation logic 1000 is incorporated proceeds with forming the image using the set of FSCCs (stage 1112). Otherwise, the controller proceeds with using just the CABC-corrected original FICC subfields.

Referring back to FIGS. 5 and 6, as set forth above, in some implementations, the subfield derivation logic 500 of a controller is configured to generate FSCC subfields using a set of FSCCs that was selected based on the data in the previous image frame, referred to as a "delayed FSCC." Doing so can be advantageous as it allows color subfield derivation (stage 406) to be carried out in parallel with selection of the set of FSCCs for the subsequent image frame (stages 605). Doing so also removes the need for a memory to store FICC subfields while they are being processed to determine the set of FSCCs. However, if the color composition of an image frame is substantially different than the color composition of a previous image frame, such as often occurs during scene changes, the use of a delayed FSCC can result in reduced image quality for the current image frame and a noticeable flicker when the FSCC changes for the frame thereafter.

The potential shortcomings of using a delayed FSCC can be mitigated, though, through the use of a FSCC smoothing process. The smoothing process can be incorporated into the selection logics 510 and 1010 shown in FIGS. 5 and 10, respectively. In general, the color smoothing process limits the degree to which the set of FSCCs is allowed to change from frame to frame.

Figure 11:
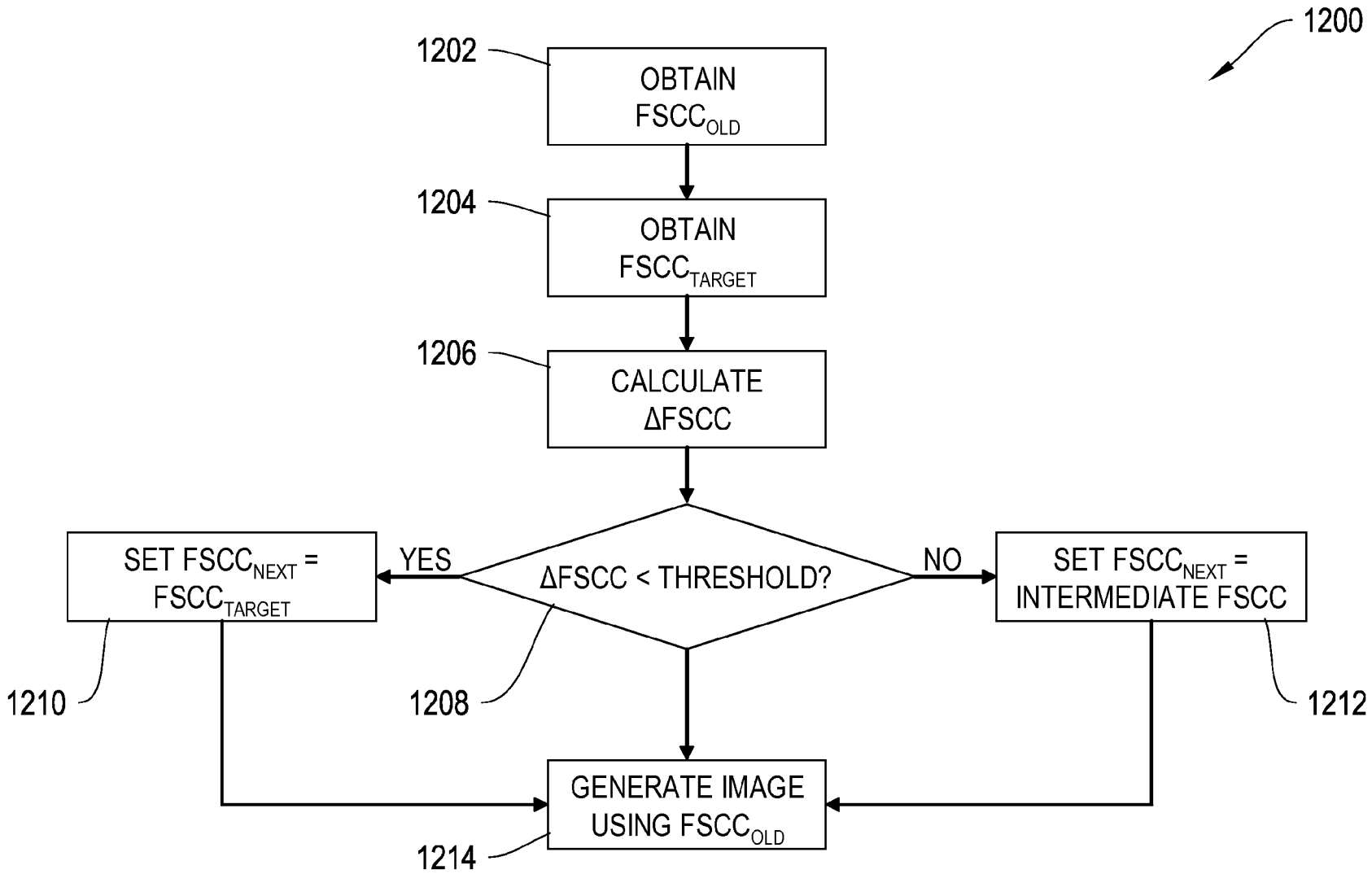
FIG. 11 shows a flow diagram of an example color FSCC smoothing process.

FIG. 11 shows a flow diagram of an example FSCC color smoothing process 1200. The FSCC color smoothing process 1200 may be executed by, for example, the selection logics 510 or 1010 shown in FIGS. 5 and 10, respectively. The process 1200 includes the selection logic obtaining a previous set of FSCCs (including one or more FSCCS denoted by $FSCCs_{old}$) (stage 1202); obtaining a new, target set of FSCCs (including one or more FSCCs denoted by $FSCCs_{target}$) (stage 1204); calculating a difference between each of the FSCCs belonging to the previous set of FSCCs and the corresponding FSCCs belonging to the target set of FSCCs, to obtain ΔFSCCs (stage 1206); and comparing each ΔFSCC to a color change threshold (stage 1208). If the ΔFSCC falls below the color change threshold, the selection logic sets the next FSCC, $FSCC_{next}$, to $FSCC_{target}$ (stage 1210). Otherwise, the selection logic sets $FSCC_{next}$ to an intermediate FSCC between the $FSCC_{old}$ and $FSCC_{target}$ (stage 1212). In either case, the current image frame is then generated using $FSCCs_{old}$.

As set forth above, the color smoothing process 1200 begins with the selection logic obtaining a previous set of FSCCs. The previous set of FSCCs can include values of one or more FSCCs denoted by $FSCCs_{old}$. For example, $FSCCs_{old}$ may be stored in memory in the controller executing the process 1200. Next, the selection logic obtains a new target set of FSCCs. The new target set of FSCCs can includes values of one or more FSCCs denoted by $FSCCs_{target}$ (stage 1204). $FSCCs_{target}$ are the FSCCs that would be used to generate the next image frame, absent any color smoothing implemented by the process 1200. The selection logic can select $FSCCs_{target}$ according to any of the FSCCs selection processes described above.

Once the $FSCCs_{old}$ and $FSCCs_{target}$ are obtained, the selection logic computes ΔFSCC (stage 1206). In some implementations, each $FSCC_{old}$ belonging to the previous set of FSCCs is compared to a closest $FSCC_{target}$, as measured by Euclidean distance in the XYZ color space or hue angle difference in hue angle space, belonging to a new target set of FSCCs. In some implementations, ΔFSCC is calculated for each FICC component used to generate the respective $FSCC_{old}$ and $FSCC_{target}$ pair. That is, the selection logic computes a $\Delta FSCC_{Red}$, a $\Delta FSCC_{Green}$, and a $\Delta FSCC_{Blue}$ equal to the difference in the red, blue, and green components, respectively of the $FSCC_{old}$ and $FSCC_{target}$ pair.

Each FICC component of $FSCC_{next}$ is then determined separately. If the intensity change in a color component falls below a corresponding color change threshold, that color component in $FSCC_{next}$ is set directly to the target intensity of that color component (stage 1208). If not, that color component in $FSCC_{next}$ is set to an intermediate value between the value of the component in $FSCC_{old}$ and $FSCC_{target}$ (stage 1210). It is computed as follows:

$$FSCC_{next}(i)=FSCC_{old}(i)+\Delta FSCC(i)*\text{percent_shift}(i),$$

where i is a FICC color component and percent_shift(i) is an error parameter defining the degree with which the component color is allowed to shift from frame to frame. In some implementations, the percent_shift(i), is set separately for each component color. Its value, in some implementations, ranges from around 1% to around 5%, though in other implementations it may be as high as about 10% or higher for one or more component colors. The selection logic, in some implementations, also applies separate color change thresholds for each color component. In other implementations, the color change threshold is constant for all component colors. Suitable thresholds, assuming an 8-bit per color grayscale scheme in which component color intensities range from 0 to 255, range from around 3 to around 25.

In some implementations, the selection logic applies multiple color change thresholds and corresponding percent_shift(i) parameters for one or more component colors. For example, in one implementation, if ΔFSCCs(i) exceed an upper threshold, then a lower percent_shift(i) parameter is applied. If ΔFSCC(i) falls between the upper threshold and a lower threshold, a second higher percent_shift(i) parameter is applied. In some implementations, the lower percent_shift(i) parameter is less than or equal to about 10%, and the second, higher percent_shift(i) parameter is between about 10% and about 50%.

In some other implementations, ΔFSCC is calculated holistically for the FSCCs in the CIE color space, using the x and y coordinates of $FSCC_{old}$ and $FSCC_{target}$. In such implementations, ΔFSCC is the Euclidean distance between the FSCCs on a CIE diagram. If the distance exceeds a color change threshold, the $FSCCs_{next}$ is set to color corresponding to a point a fraction (percent_shift_CIE) of the way along a line connecting $FSCCs_{old}$ and $FSCCs_{target}$ in the CIE diagram. Similar distances can be computed using the FSCCs' tristimulus values.

The above process is repeated for each pair of $FSCC_{old}$ and $FSCC_{target}$ belonging to the previous set of FSCCs and the new target pair of FSCCs, respectively, to generate a set of next FSCCs including one or more $FSCCs_{next}$. After the selection logic determines all $FSCCs_{next}$, the current image frame is displayed using $FSCCs_{old}$, and $FSCCs_{next}$ is stored as the new $FSCCs_{old}$ for use in the next image frame.

Referring back to FIG. 1B and FIG. 3, the display apparatus 128 includes only red, green, blue and white LEDs. However, as described above, several of the FSCC selection processes disclosed above enable a controller 134, such as the controller 300, to select a wide range of colors as the FSCC. Assuming the FSCC is not selected to be the exact white provided by the white LED, the display apparatus 128 illuminates two or more of the LEDs to generate the FSCC. The output control logic 308 of the controller 300 is configured to calculate the appropriate combinations of illumination intensities of the LEDs to form the FSCC. In theory, given that the display apparatus includes red, green, blue, and white LEDs, there are an infinite number of illumination intensity combinations that would generate the FSCC. Thus, at different times different color combinations may be employed to generate the same FSCC. In some implementations, to avoid image artifacts that could result from generating the same FSCC using different color combinations at different times, the output logic 308 is configured to select a set of LED illumination intensities using an algorithm that has only a limited number of possible solution (such as one solution).

Figure 12:
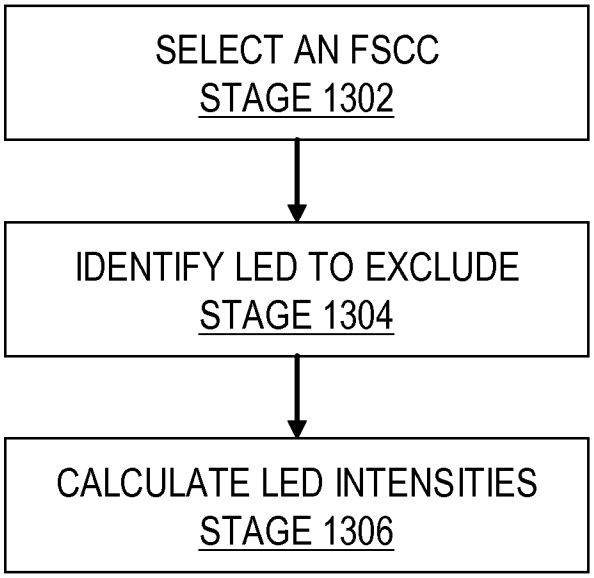
FIG. 12 shows a flow diagram of a process of calculating LED intensities for generating a FSCC.

FIG. 12 shows a flow diagram of a process 1300 of calculating LED intensities for generating a FSCC. The process 1300 includes selecting a FSCC (stage 1302); identifying a non-white LED to exclude from the generation of the FSCC (stage 1304); and calculating the LED intensities for the subset of LEDs based on the selected FSCC (stage 1306).

Referring to FIGS. 3 and 12, as set forth above, the process 1300 begins with the selection of a FSCC (stage 1302). The FSCC can be selected by the subfield generation logic 304 of the controller 300 using any of the FSCC selection processes described above.

Then, the output logic 308 of the controller 300 identifies a non-white LED to exclude from the generation of the FSCC (stage 1304). Given that the display apparatus includes a white LED, and that such LEDs are more efficient than color LEDs, it is beneficial to have as much luminance in an image provided by the white LED as possible to reduce power consumption of the display. In addition, any composite color can be formed from a combination of white and two of red, blue, and green.

Figure 13:
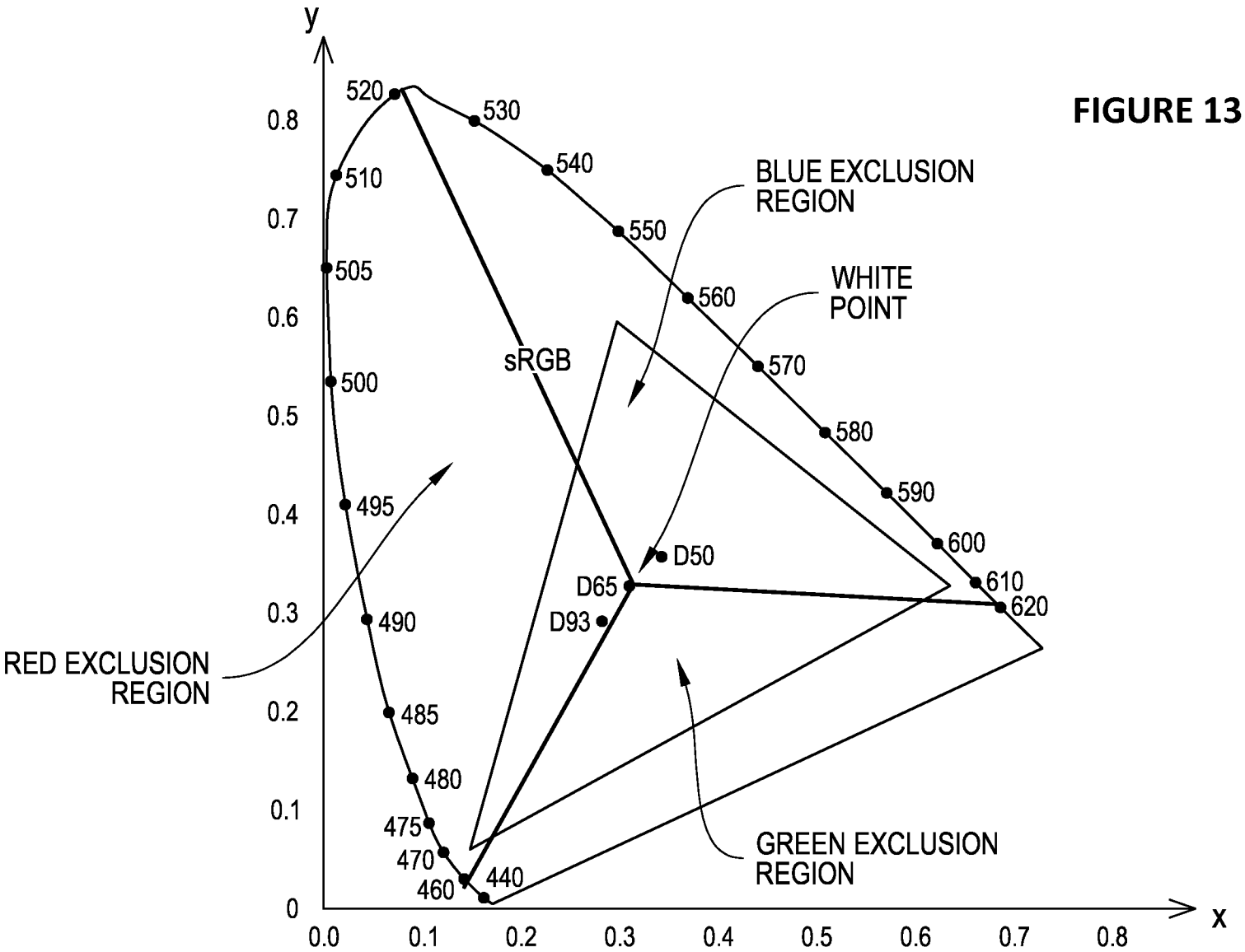
FIG. 13 shows a color gamut of display in the CIE color space segmented for LED selection.

FIG. 13 shows a color gamut of display in the CIE color space segmented for LED selection. Conceptually, the decision as to which non-white LED should be excluded can be described with respect to a color gamut which has been segmented into LED exclusion regions. Each exclusion region includes a set of colors, which if chosen as a set of FSCCs, are generated without using a corresponding excluded LED. In one implementation, the boundaries between segments can be set as lines that connect the x, y coordinates in the CIE color space of the LEDs (excluding the white LED) to the white point of the gamut. Each region therefore includes a set of colors in a triangular shape having vertices defined by two LED color coordinates and the white point color coordinates. The excluded LED associated with a region is the LED whose color coordinates do not serve as one of the vertices of the region.

Once the excluded LED is identified, the relative intensities of the two remaining LEDs and the white LED can be calculated by solving the equation:

$$\begin{bmatrix} I_1 \\ I_2 \\ I_W \end{bmatrix} = \begin{bmatrix} X_{FSCC} \\ Y_{FSCC} \\ Z_{FSCC} \end{bmatrix} \times \begin{bmatrix} X_{LED1} & X_{LED2} & X_{LEDW} \\ Y_{LED1} & Y_{LED2} & Y_{LEDW} \\ Z_{LED1} & Z_{LED2} & Z_{LEDW} \end{bmatrix}^{-1}$$

where $X_{FSCC}$, $Y_{FSCC}$, and $Z_{FSCc}$ correspond to the tristimulus values of the FSCC, $X_{LED1}$, $Y_{LED1}$, and $Z_{LED1}$ correspond to the tristimulus values of the first LED used to form the FSCC; $X_{LED2}$, $Y_{LED2}$, and $Z_{LED2}$ correspond to the tristimulus values of the second LED used to form the FSCC; $X_{LEDW}$, $Y_{LEDW}$, and $Z_{LEDW}$ correspond to the tristimulus values of the white LED used to form the FSCC; and $I_1$, $I_2$, and $I_W$ correspond to the intensities to which the first, second, and white LEDs are to be illuminated to generate the FSCC.

Figure 14:
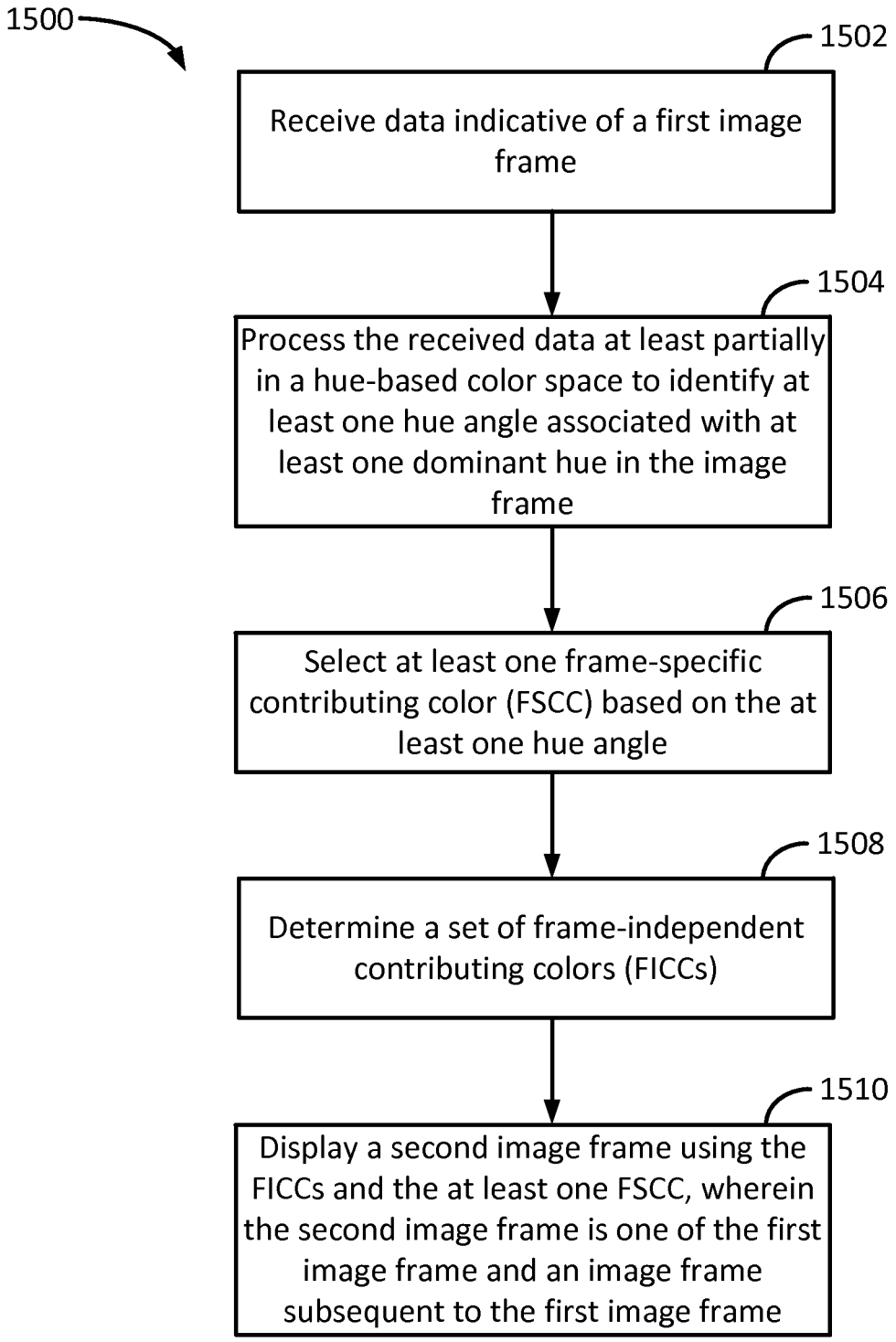
FIG. 14 shows a flow diagram of an example process for generating an image on a display.

FIG. 14 shows a flow diagram of an example process 1500 for generating an image on a display. In particular, the process 1500 shown in FIG. 14 includes receiving data indicative of a first image frame (stage 1502); processing the received data at least partially in a hue-based color space to identify at least one hue angle associated with at least one dominant hue in the image frame (stage 1504); selecting at least one frame-specific contributing color (FSCC) based on the at least one hue angle (stage 1506); determining a set of frame-independent contributing colors (FICCs) (stage 1508); and displaying a second image frame using the FICCs and the at least one FSCC, where the second image frame is one of the first image frame and an image frame subsequent to the first image frame (stage 1510).

The process 1500 includes receiving data indicative of a first image frame (stage 1502). Examples of this process stage have been discussed above in relation to FIGS. 3, 5 and 9. Specifically, as shown in FIG. 3, input logic 302 can include a data port that can receive image data from an outside source. The input logic 302 then passes the received image data to the subfield derivation logic 304 for further processing. Furthermore, FIG. 5 shows an example of a subfield derivation logic 500 receiving data related to a first image frame. Similarly, FIG. 9 shows another example of a subfield derivation logic 1000 receiving data related to a first image frame.

The process 1500 also includes processing the received data at least partially in a hue-based color space to identify at least one hue angle associated with at least one dominant hue in the image frame (stage 1504). One example of this process stage has been discussed above in relation to FIGS. 5 and 8. Specifically, FIG. 5 shows contributing color selection logic 502 for analyzing the first image frame. The contributing color selection logic 502 processes the first image data to generate a distribution, by way of a histogram shown in FIG. 8, of the hue angles within the image frame. The distribution of hue angles is used to determine the dominant hues within the image frame. For example, as shown in FIG. 8, the contributing color selection logic 502 selects hue angles belonging to bin-13 as representing the hue angle associated with the most dominant hue in the image frame.

The process 1500 further includes selecting at least one frame-specific contributing color (FSCC) based on the at least one hue angle (stage 1506). One example of this process stage has been discussed above in relation to FIGS. 5 and 7. Specifically, FIG. 5 shows contributing color selection logic 502 for analyzing the first image frame. Furthermore, stages 708 and 710 of the process 700 shown in FIG. 7 show converting N dominant hues from the hue-based color space into the RGB color space and using the converted RGB values as one of the FSCCs.

The process 1500 also includes determining a set of frame-independent contributing colors (FICCs) (stage 1508). One example of this process stage has been discussed above in relation to FIGS. 3 and 4. Specifically, FIG. 3 shows a controller including subfield derivation logic 304 for processing an image frame received from the input logic 302. Furthermore, stage 406 of the process shown in FIG. 4, which can be executed by the controller 300, shows the derivation of frame-independent color subfields.

The process 1500 also includes displaying a second image frame using the FICCs and the at least one FSCC, where the second image frame is one of the first image frame and an image frame subsequent to the first image frame (stage 1510). One example of this process stage has been discussed above in relation to FIGS. 5 and 6. For example, FIG. 5 shows pixel transformation logic 504, which identifies a set of FSCCs as well as FICCs to be displayed in an image frame. Furthermore, stages 605 and 608 of the process 600, shown in FIG. 6, show that FICCs are adjusted based on the FSCCs for display and that the FSCCs are selected for display in the subsequent image frame.

Figure 15A:
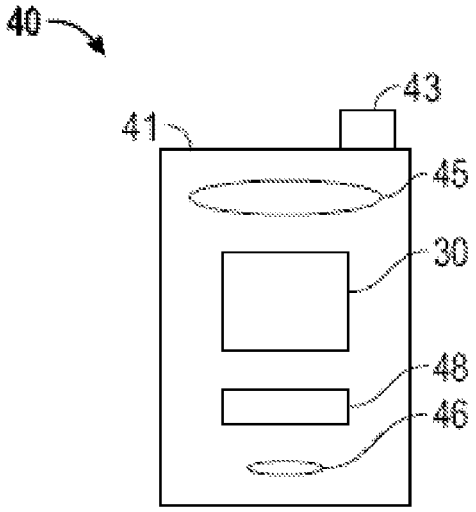
FIGS. 15A and 15B show system block diagrams illustrating a display device that includes a plurality of display elements.
Figure 15B:
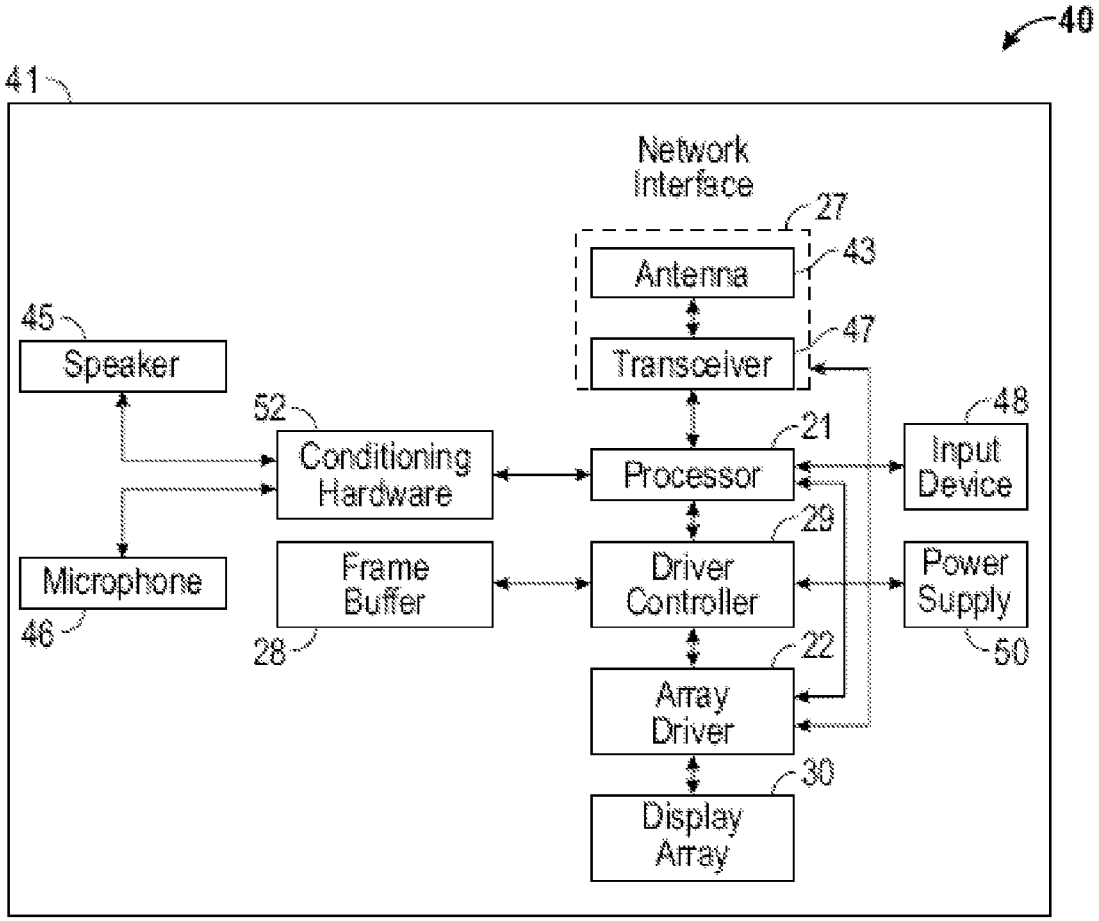

FIGS. 15A and 15B show system block diagrams of an example display device 40 that includes a plurality of display elements. The display device 40 can be, for example, a smart phone, a cellular or mobile telephone. However, the same components of the display device 40 or slight variations thereof are also illustrative of various types of display devices such as televisions, computers, tablets, e-readers, hand-held devices and portable media devices.

The display device 40 includes a housing 41, a display 30, an antenna 43, a speaker 45, an input device 48 and a microphone 46. The housing 41 can be formed from any of a variety of manufacturing processes, including injection molding, and vacuum forming. In addition, the housing 41 may be made from any of a variety of materials, including, but not limited to: plastic, metal, glass, rubber and ceramic, or a combination thereof The housing 41 can include removable portions (not shown) that may be interchanged with other removable portions of different color, or containing different logos, pictures, or symbols.

The display 30 may be any of a variety of displays, including a bi-stable or analog display, as described herein. The display 30 also can be configured to include a flat-panel display, such as plasma, electroluminescent (EL) displays, OLED, super twisted nematic (STN) display, LCD, or thin-film transistor (TFT) LCD, or a non-flat-panel display, such as a cathode ray tube (CRT) or other tube device. In addition, the display 30 can include a mechanical light modulator-based display, as described herein.

The components of the display device 40 are schematically illustrated in FIG. 15A. The display device 40 includes a housing 41 and can include additional components at least partially enclosed therein. For example, the display device 40 includes a network interface 27 that includes an antenna 43 which can be coupled to a transceiver 47. The network interface 27 may be a source for image data that could be displayed on the display device 40. Accordingly, the network interface 27 is one example of an image source module, but the processor 21 and the input device 48 also may serve as an image source module. The transceiver 47 is connected to a processor 21, which is connected to conditioning hardware 52. The conditioning hardware 52 may be configured to condition a signal (such as filter or otherwise manipulate a signal). The conditioning hardware 52 can be connected to a speaker 45 and a microphone 46. The processor 21 also can be connected to an input device 48 and a driver controller 29. The driver controller 29 can be coupled to a frame buffer 28, and to an array driver 22, which in turn can be coupled to a display array 30. One or more elements in the display device 40, including elements not specifically depicted in FIGS. 15A and 15B, can be configured to function as a memory device and be configured to communicate with the processor 21. In some implementations, a power supply 50 can provide power to substantially all components in the particular display device 40 design.

The network interface 27 includes the antenna 43 and the transceiver 47 so that the display device 40 can communicate with one or more devices over a network. The network interface 27 also may have some processing capabilities to relieve, for example, data processing requirements of the processor 21. The antenna 43 can transmit and receive signals. In some implementations, the antenna 43 transmits and receives RF signals according to the IEEE 16.11 standard, including IEEE 16.11(a), (b), or (g), or the IEEE 802.11 standard, including IEEE 802.11a, b, g, n, ac, and further implementations thereof. In some other implementations, the antenna 43 transmits and receives RF signals according to the Bluetooth® standard. In the case of a cellular telephone, the antenna 43 can be designed to receive code division multiple access (CDMA), frequency division multiple access (FDMA), time division multiple access (TDMA), Global System for Mobile communications (GSM), GSM/General Packet Radio Service (GPRS), Enhanced Data GSM Environment (EDGE), Terrestrial Trunked Radio (TETRA), Wideband-CDMA (W-CDMA), Evolution Data Optimized (EV-DO), 1xEV-DO, EV-DO Rev A, EV-DO Rev B, High Speed Packet Access (HSPA), High Speed Downlink Packet Access (HSDPA), High Speed Uplink Packet Access (HSUPA), Evolved High Speed Packet Access (HSPA+), Long Term Evolution (LTE), AMPS, or other known signals that are used to communicate within a wireless network, such as a system utilizing 3G, 4G or 5G technology. The transceiver 47 can preprocess the signals received from the antenna 43 so that they may be received by and further manipulated by the processor 21. The transceiver 47 also can process signals received from the processor 21 so that they may be transmitted from the display device 40 via the antenna 43.

In some implementations, the transceiver 47 can be replaced by a receiver. In addition, in some implementations, the network interface 27 can be replaced by an image source, which can store or generate image data to be sent to the processor 21. The processor 21 can control the overall operation of the display device 40. The processor 21 receives data, such as compressed image data from the network interface 27 or an image source, and processes the data into raw image data or into a format that can be readily processed into raw image data. The processor 21 can send the processed data to the driver controller 29 or to the frame buffer 28 for storage. Raw data typically refers to the information that identifies the image characteristics at each location within an image. For example, such image characteristics can include color, saturation and gray-scale level.

The processor 21 can include a microcontroller, CPU, or logic unit to control operation of the display device 40. The conditioning hardware 52 may include amplifiers and filters for transmitting signals to the speaker 45, and for receiving signals from the microphone 46. The conditioning hardware 52 may be discrete components within the display device 40, or may be incorporated within the processor 21 or other components.

The driver controller 29 can take the raw image data generated by the processor 21 either directly from the processor 21 or from the frame buffer 28 and can re-format the raw image data appropriately for high speed transmission to the array driver 22. In some implementations, the driver controller 29 can re-format the raw image data into a data flow having a raster-like format, such that it has a time order suitable for scanning across the display array 30. Then the driver controller 29 sends the formatted information to the array driver 22. Although a driver controller 29, such as an LCD controller, is often associated with the system processor 21 as a standalone Integrated Circuit (IC), such controllers may be implemented in many ways. For example, controllers may be embedded in the processor 21 as hardware, embedded in the processor 21 as software, or fully integrated in hardware with the array driver 22.

The array driver 22 can receive the formatted information from the driver controller 29 and can re-format the video data into a parallel set of waveforms that are applied many times per second to the hundreds, and sometimes thousands (or more), of leads coming from the display's x-y matrix of display elements. In some implementations, the array driver 22 and the display array 30 are a part of a display module. In some implementations, the driver controller 29, the array driver 22, and the display array 30 are a part of the display module.

In some implementations, the driver controller 29, the array driver 22, and the display array 30 are appropriate for any of the types of displays described herein. For example, the driver controller 29 can be a conventional display controller or a bi-stable display controller (such as a mechanical light modulator display element controller). Additionally, the array driver 22 can be a conventional driver or a bi-stable display driver (such as a mechanical light modulator display element controller). Moreover, the display array 30 can be a conventional display array or a bi-stable display array (such as a display including an array of mechanical light modulator display elements). In some implementations, the driver controller 29 can be integrated with the array driver 22. Such an implementation can be useful in highly integrated systems, for example, mobile phones, portable-electronic devices, watches or small-area displays.

In some implementations, the input device 48 can be configured to allow, for example, a user to control the operation of the display device 40. The input device 48 can include a keypad, such as a QWERTY keyboard or a telephone keypad, a button, a switch, a rocker, a touch-sensitive screen, a touch-sensitive screen integrated with the display array 30, or a pressure- or heat-sensitive membrane. The microphone 46 can be configured as an input device for the display device 40. In some implementations, voice commands through the microphone 46 can be used for controlling operations of the display device 40.

The power supply 50 can include a variety of energy storage devices. For example, the power supply 50 can be a rechargeable battery, such as a nickel-cadmium battery or a lithium-ion battery. In implementations using a rechargeable battery, the rechargeable battery may be chargeable using power coming from, for example, a wall socket or a photovoltaic device or array. Alternatively, the rechargeable battery can be wirelessly chargeable. The power supply 50 also can be a renewable energy source, a capacitor, or a solar cell, including a plastic solar cell or solar-cell paint. The power supply 50 also can be configured to receive power from a wall outlet.

In some implementations, control programmability resides in the driver controller 29 which can be located in several places in the electronic display system. In some other implementations, control programmability resides in the array driver 22. The above-described optimization may be implemented in any number of hardware and/or software components and in various configurations.

As used herein, a phrase referring to "at least one of" a list of items refers to any combination of those items, including single members. As an example, "at least one of: a, b, or c" is intended to cover: a, b, c, a-b, a-c, b-c, and a-b-c.

The various illustrative logics, logical blocks, modules, circuits and algorithm processes described in connection with the implementations disclosed herein may be implemented as electronic hardware, computer software, or combinations of both. The interchangeability of hardware and software has been described generally, in terms of functionality, and illustrated in the various illustrative components, blocks, modules, circuits and processes described above. Whether such functionality is implemented in hardware or software depends upon the particular application and design constraints imposed on the overall system.

The hardware and data processing apparatus used to implement the various illustrative logics, logical blocks, modules and circuits described in connection with the aspects disclosed herein may be implemented or performed with a general purpose single- or multi-chip processor, a digital signal processor (DSP), an application specific integrated circuit (ASIC), a field programmable gate array (FPGA) or other programmable logic device, discrete gate or transistor logic, discrete hardware components, or any combination thereof designed to perform the functions described herein. A general purpose processor may be a microprocessor, or, any conventional processor, controller, microcontroller, or state machine. A processor also may be implemented as a combination of computing devices, such as a combination of a DSP and a microprocessor, a plurality of microprocessors, one or more microprocessors in conjunction with a DSP core, or any other such configuration. In some implementations, particular processes and methods may be performed by circuitry that is specific to a given function.

In one or more aspects, the functions described may be implemented in hardware, digital electronic circuitry, computer software, firmware, including the structures disclosed in this specification and their structural equivalents thereof, or in any combination thereof Implementations of the subject matter described in this specification also can be implemented as one or more computer programs, i.e., one or more modules of computer program instructions, encoded on a computer storage media for execution by, or to control the operation of, data processing apparatus.

If implemented in software, the functions may be stored on or transmitted over as one or more instructions or code on a computer-readable medium. The processes of a method or algorithm disclosed herein may be implemented in a processor-executable software module which may reside on a computer-readable medium. Computer-readable media includes both computer storage media and communication media including any medium that can be enabled to transfer a computer program from one place to another. A storage media may be any available media that may be accessed by a computer. By way of example, and not limitation, such computer-readable media may include RAM, ROM, EEPROM, CD-ROM or other optical disk storage, magnetic disk storage or other magnetic storage devices, or any other medium that may be used to store desired program code in the form of instructions or data structures and that may be accessed by a computer. Also, any connection can be properly termed a computer-readable medium. Disk and disc, as used herein, includes compact disc (CD), laser disc, optical disc, digital versatile disc (DVD), floppy disk, and blu-ray disc where disks usually reproduce data magnetically, while discs reproduce data optically with lasers. Combinations of the above should also be included within the scope of computer-readable media. Additionally, the operations of a method or algorithm may reside as one or any combination or set of codes and instructions on a machine readable medium and computer-readable medium, which may be incorporated into a computer program product.

Various modifications to the implementations described in this disclosure may be readily apparent to those skilled in the art, and the generic principles defined herein may be applied to other implementations without departing from the spirit or scope of this disclosure. Thus, the claims are not intended to be limited to the implementations shown herein, but are to be accorded the widest scope consistent with this disclosure, the principles and the novel features disclosed herein.

Additionally, a person having ordinary skill in the art will readily appreciate, the terms "upper" and "lower" are sometimes used for ease of describing the figures, and indicate relative positions corresponding to the orientation of the figure on a properly oriented page, and may not reflect the proper orientation of any device as implemented.

Certain features that are described in this specification in the context of separate implementations also can be implemented in combination in a single implementation. Conversely, various features that are described in the context of a single implementation also can be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. Further, the drawings may schematically depict one more example processes in the form of a flow diagram. However, other operations that are not depicted can be incorporated in the example processes that are schematically illustrated. For example, one or more additional operations can be performed before, after, simultaneously, or between any of the illustrated operations. In certain circumstances, multitasking and parallel processing may be advantageous. Moreover, the separation of various system components in the implementations described above should not be understood as requiring such separation in all implementations, and it should be understood that the described program components and systems can generally be integrated together in a single software product or packaged into multiple software products. Additionally, other implementations are within the scope of the following claims. In some cases, the actions recited in the claims can be performed in a different order and still achieve desirable results.

What is claimed is:

1. An apparatus, comprising:

a plurality of light sources configured to emit a plurality of colors generally corresponding to a set of frame independent contributing colors (FICCs); and a controller coupled to the plurality of light sources, comprising:

input logic configured to receive data indicative of a first image frame;

subfield derivation logic configured to identify at least one frame specific contributing color (FSCC) for use in display of a second image frame, wherein the second image frame is one of the first image frame and an image frame subsequent to the first image frame, by processing the data at least partially in a hue-based color space to identify a hue angle of a dominant hue in the first image frame;

select the FSCC based on the identified hue angle; and cause the second image frame to be displayed using the FICCs and the FSCC.

2. The apparatus of claim 1, wherein the subfield logic is further configured to Identify three FSCCs by identifying hue angles associated with three dominant hues in the first image frame; and to cause the second image frame to be displayed using the FICCs and the three identified FSCCs.

3. The apparatus of claim 1, wherein the subfield derivation logic is further configured to set the FSCC to correspond to the identified dominant hue by obtaining a set of relative illumination intensities for the plurality of light sources based on the identified dominant hue.

4. The apparatus of claim 1, wherein the subfield derivation logic is further configured to process the data at least partially in the hue-based color space by determining a frequency distribution of a plurality of hues in the first image frame.

5. The apparatus of claim 4, wherein the subfield derivation logic is further configured to process the data at least partially in the hue-based color space by converting a plurality of pixel values included in the received data from an RGB color space to the hue-based color space.

6. The apparatus of claim 1, wherein the controller is configured to display the second image frame using the FICCs and the at least one FSCC such that the majority of the light energy output for the second image frame is output using the at least one FSCC.

7. The apparatus of claim 1, wherein the controller is configured to display the second image frame using the FICCs and the at least one FSCC such that at least one subframe caused to be displayed for at least one FICC has a corresponding weight that is less than lowest weight of any subframe displayed for the at least one FSCC.

8. The apparatus of claim 1, wherein the subfield derivation logic is further configured to cause the second image frame to be displayed using the FICCs and the FSCC based on a determination that an estimated power consumed by the apparatus for displaying the second image frame using FICCs and the FSCC is less than an estimated power consumed by the apparatus for displaying the second image frame using only FICCs.

9. The apparatus of claim 1, further comprising:

a display including the plurality of light sources;

a processor that is configured to communicate with the display, the processor being configured to process image data; and a memory device that is configured to communicate with the processor.

10. The apparatus of claim 9, the display further including:

a driver circuit configured to send at least one signal to the display; and the controller configured to send at least a portion of the image data to the driver circuit.

11. The apparatus of claim 9, the display further including:

an image source module configured to send the image data to the processor, wherein the image source module includes at least one of a receiver, transceiver, and a transmitter.

12. The apparatus of claim 9, the display further including:

an input device configured to receive input data and to communicate the input data to the processor.

13. A method for displaying an image frame comprising:

receiving data indicative of a first image frame;

processing the received data at least partially in a hue-based color space to identify at least one hue angle associated with at least one dominant hue in the first image frame;

selecting at least one frame-specific contributing color (FSCC) based on the at least one hue angle;

determining a set of frame-independent contributing colors (FICCs); and displaying a second image frame using the FICCs and the at least one FSCC, wherein the second image frame is one of the first image frame and an image frame subsequent to the first image frame.

14. The method of claim 13, wherein selecting the at least one FSCC includes selecting three FSCCs based on identifying hue angles associated with three dominant hues in the first image frame, and wherein displaying the second image frame includes displaying the second image frame using the FICCs and the three FSCCs.

15. The method of claim 13, wherein processing the received data at least partially in the hue-based color space includes determining a frequency distribution of a plurality of hues in the first image frame.

16. The method of claim 15, wherein processing the received data at least partially in the hue-based color space further includes converting a plurality of pixel values included in the received data from an RGB color space to the hue-based color space.

17. The method of claim 13, wherein displaying the second image frame using the FICCs and the at least one FSCC includes displaying the second image frame such that a majority of a light energy output for the second image frame is output using the at least one FSCC.

18. The method of claim 13, wherein displaying the second image frame using the FICCs and the at least one FSCC includes displaying the second image frame such that at least one subframe caused to be displayed for at least one of the FICCs has a corresponding weight that is less than a lowest weight of any subframe caused to be displayed for the at least one FSCC.

19. The method of claim 13, wherein displaying the second image frame using the FICCs and the at least one FSCC includes determining that an estimated power consumed for displaying the second image frame using the FICCs and the at least one FSCC is less than an estimated power consumed for displaying the second image frame using only the FICCs.

20. A non-transitory computer readable storage medium having instructions encoded thereon, which when executed by a processor cause the processor to perform a method for displaying an image, comprising:

receiving data indicative of a first image frame;

processing the received data at least partially in a hue-based color space to identify at least one hue angle associated with at least one dominant hue in the first image frame;

selecting at least one frame-specific contributing color (FSCC) based on the at least one hue angle;

determining a set of frame-independent contributing colors (FICCs); and displaying a second image frame using the FICCs and the at least one FSCC, wherein the second image frame is one of the first image frame and an image frame subsequent to the first image frame.

21. The non-transitory computer readable storage medium of claim 20, wherein selecting the at least one FSCC includes selecting three FSCCs based on identifying hue angles associated with three dominant hues in the first image frame, and wherein displaying the second image frame includes displaying the second image frame using the FICCs and the three FSCCs.

22. The non-transitory computer readable storage medium of claim 20, wherein displaying the second image frame using the FICCs and the at least one FSCC includes displaying the second image frame such that at least one subframe caused to be displayed for at least one of the FICCs has a corresponding weight that is less than a lowest weight of any subframe caused to be displayed for the at least one FSCC.

23. The non-transitory computer readable storage medium of claim 20, wherein processing the received data at least partially in the hue-based color space includes determining a frequency distribution of a plurality of hues in the first image frame.

* * * * *